US012146679B1

(12) United States Patent
Pecchia

(10) Patent No.: US 12,146,679 B1
(45) Date of Patent: Nov. 19, 2024

(54) TOOLLESS INSTALLATION OF VENT ASSEMBLY

(71) Applicant: Filtrex Pure Air, LLC, Boardman, OH (US)

(72) Inventor: Dominic Pecchia, Youngstown, OH (US)

(73) Assignee: FILTREX PURE AIR, LLC, Boardman, OH (US)

( * ) Notice: Subject to any disclaimer, the term of this patent is extended or adjusted under 35 U.S.C. 154(b) by 0 days.

(21) Appl. No.: 18/330,837

(22) Filed: Jun. 7, 2023

(51) Int. Cl.
*F24F 13/08* (2006.01)

(52) U.S. Cl.
CPC ..... *F24F 13/084* (2013.01); *F24F 13/085* (2013.01)

(58) Field of Classification Search
CPC ..... F24F 13/084; F24F 13/085
See application file for complete search history.

(56) References Cited

U.S. PATENT DOCUMENTS 1,801,949 A 4/1931 Broudy et al.
1,873,573 A 8/1932 Galvin
2,551,408 A 5/1951 Amundson
2,575,499 A 11/1951 Manow
2,789,663 A 4/1957 Camp
2,825,500 A 3/1958 Mclean
2,881,854 A 4/1959 Uehre, Jr.
2,992,702 A 7/1961 Reid
3,046,719 A 7/1962 Tropiano
3,169,475 A 2/1965 Caouette
3,252,580 A 5/1966 Getzin
3,494,113 A 2/1970 Kinney
3,626,668 A 12/1971 Cardiff
3,675,402 A 7/1972 Weed
3,740,934 A 6/1973 Shuler
3,767,260 A 10/1973 Limpach
3,831,765 A 8/1974 Flynn et al.
3,853,529 A 12/1974 Farr et al.
3,864,889 A 2/1975 Hobbs
3,938,430 A 2/1976 Koppang
4,088,463 A 5/1978 Smith
4,334,899 A 6/1982 Mcconnell
4,340,402 A 7/1982 Catron
4,394,147 A 7/1983 Caddy et al.
4,518,402 A 5/1985 Dargel
4,521,234 A 6/1985 Peebles, Jr. et al.
4,601,737 A 7/1986 Gerbig
4,626,265 A 12/1986 Adiletta
4,629,479 A 12/1986 Cantoni
4,713,099 A 12/1987 Schroeder
4,843,835 A 7/1989 Goetz et al.
4,889,542 A 12/1989 Hayes
4,982,627 A 1/1991 Johnson
(Continued)

*Primary Examiner* — Bayan Salone
(74) *Attorney, Agent, or Firm* — Sand, Sebolt & Wernow Co., LPA

(57) ABSTRACT

A filtered air vent apparatus has a vent housing body comprising a first sidewall and a second sidewall defining a portion of an air passageway that extends between at least a first open end and a second open end. There is a grill hingedly attachable to the vent housing body and securable to the vent housing body. A connector provides a snap-in configuration that permits or effectuates toolless installation of the filtered air vent apparatus. A filter is selectively and removably positioned behind the grill and in the air passageway.

21 Claims, 16 Drawing Sheets

(56) References Cited

U.S. PATENT DOCUMENTS 5,037,455 A 8/1991 Scheineson et al.
5,045,184 A 9/1991 Arkles
5,059,218 A 10/1991 Pick
5,087,276 A 2/1992 Snyder
5,100,445 A 3/1992 Johnson et al.
5,100,455 A 3/1992 Pinckard et al.
5,114,448 A 5/1992 Bartilson
5,176,570 A * 1/1993 Liedl ..... F24F 13/28 55/502
5,183,488 A 2/1993 Deering
5,188,646 A 2/1993 Nolen, Jr.
5,221,520 A 6/1993 Cornwell
5,230,799 A 7/1993 Willard et al.
5,240,487 A 8/1993 Kung
5,332,409 A 7/1994 Dralle
5,334,347 A 8/1994 Hollander
5,364,458 A 11/1994 Burnett et al.
5,421,862 A 6/1995 Davis
5,423,903 A 6/1995 Schmitz et al.
5,458,772 A 10/1995 Eskes et al.
5,462,569 A 10/1995 Benjamin
5,476,526 A 12/1995 Attermeyer
5,525,136 A 6/1996 Rosen
5,525,145 A 6/1996 Hodge
5,597,392 A 1/1997 Hawkins et al.
5,643,081 A 7/1997 Klein
5,689,969 A 11/1997 Conroy
5,690,719 A 11/1997 Hodge
5,707,411 A 1/1998 Rodaway et al.
5,716,270 A 2/1998 Chambers
5,720,660 A 2/1998 Benedetto et al.
5,772,713 A 6/1998 Salinas et al.
5,776,218 A 7/1998 Enns
5,782,944 A 7/1998 Justice
5,817,168 A 10/1998 Wheless
5,817,276 A 10/1998 Fencl et al.
5,863,310 A 1/1999 Brown et al.
5,866,076 A 2/1999 Fencl et al.
5,944,860 A 8/1999 Mack et al.
6,030,427 A 2/2000 Sorice et al.
6,066,044 A 5/2000 Orendorff
6,074,450 A 6/2000 Raber
6,110,260 A 8/2000 Kubokawa
6,126,708 A 10/2000 Mack et al.
6,156,089 A 12/2000 Stemmer et al.
6,185,097 B1 2/2001 Behl
6,241,603 B1 6/2001 Watson
6,241,794 B1 6/2001 Jadran et al.
6,245,293 B1 6/2001 Fencl et al.
6,257,976 B1 7/2001 Richardson
6,267,924 B1 7/2001 Fencl et al.
6,280,686 B1 8/2001 Scheir et al.
6,313,470 B1 11/2001 Fencl et al.
6,358,139 B1 3/2002 Renz
6,361,578 B1 3/2002 Rubinson
6,371,846 B1 4/2002 Powell et al.
6,372,186 B1 4/2002 Fencl et al.
6,379,412 B1 4/2002 Porterfield
6,422,935 B1 7/2002 Yampolski
6,423,882 B1 7/2002 Fencl
6,475,270 B1 11/2002 Graeve
6,488,578 B1 12/2002 Kuo
6,497,740 B1 12/2002 Moretti
6,500,267 B1 12/2002 Fencl et al.
6,506,113 B2 1/2003 Berger
6,554,880 B1 4/2003 Northcutt
6,589,476 B1 7/2003 Fencl
6,623,540 B2 9/2003 Clayton et al.
6,627,000 B2 9/2003 Fencl et al.
6,641,648 B2 11/2003 Walker et al.
6,652,748 B1 11/2003 Choi
6,656,243 B2 12/2003 Hodge
6,716,266 B2 4/2004 Mcnaughton
6,716,267 B2 4/2004 Lawlor
6,719,820 B2 4/2004 Wolf et al.
6,723,150 B2 4/2004 Parker
6,749,499 B1 6/2004 Snyder
6,790,261 B1 9/2004 Delts
6,793,703 B1 9/2004 Sledge et al.
6,793,715 B1 9/2004 Sandberg
6,797,028 B2 * 9/2004 Duffy ..... F24F 13/28 55/DIG. 35
6,800,106 B2 10/2004 Cogar et al.
6,814,660 B1 11/2004 Cavett
6,848,990 B2 2/2005 Berger
6,913,637 B2 7/2005 Kim
6,918,940 B1 7/2005 Lackey et al.
6,941,630 B2 9/2005 Wynn
6,942,710 B2 9/2005 Milano
6,979,361 B2 12/2005 Mihayiov et al.
6,997,578 B2 2/2006 Culbert et al.
7,037,354 B1 5/2006 Dimicelli
7,090,713 B2 8/2006 Terlson
7,097,558 B2 8/2006 Berger
7,097,692 B2 8/2006 Southland et al.
7,128,643 B2 10/2006 Beliveau et al.
7,156,891 B2 1/2007 Winters et al.
7,169,202 B2 1/2007 Kubokawa
7,364,602 B2 4/2008 Wu et al.
7,416,577 B2 8/2008 Simmons
7,503,953 B2 3/2009 Sundet et al.
7,524,362 B2 4/2009 Wu et al.
7,537,632 B2 5/2009 Miller et al.
7,575,617 B2 8/2009 Ferguson
7,674,307 B2 3/2010 Solberg, Jr. et al.
7,753,982 B2 7/2010 Merritt
7,789,928 B2 9/2010 Stepp
7,806,948 B2 10/2010 Brock et al.
7,811,346 B1 10/2010 Henson
7,922,003 B2 4/2011 Timmerman et al.
7,942,957 B2 5/2011 Lee et al.
7,993,434 B2 8/2011 Oscar
7,993,589 B1 8/2011 Shigemoto et al.
8,016,921 B2 9/2011 Hassell et al.
8,021,454 B2 9/2011 Braunecker et al.
8,216,034 B1 7/2012 Sona et al.
8,241,381 B2 8/2012 Jackson et al.
8,388,717 B2 3/2013 Livingstone et al.
8,647,405 B2 2/2014 Gray, Jr. et al.
8,662,971 B2 3/2014 Warner
D710,000 S 7/2014 Moreno
8,784,528 B2 7/2014 Gorman
8,789,457 B2 7/2014 Tonelli et al.
8,814,144 B2 8/2014 Mctaw, Jr.
8,864,560 B2 10/2014 Yeh et al.
8,870,995 B1 10/2014 Bender
9,011,565 B2 4/2015 Cannon
9,034,068 B2 5/2015 Ball et al.
9,049,838 B2 6/2015 Crabtree et al.
9,049,839 B2 6/2015 Crabtree
9,127,856 B2 9/2015 Cole
9,132,373 B2 9/2015 Loggins et al.
9,169,639 B1 10/2015 Conroy
9,185,877 B2 11/2015 Crabtree et al.
9,237,674 B2 1/2016 Hartmann et al.
9,328,754 B2 5/2016 Stokes
9,333,450 B2 5/2016 Hamlin et al.
9,518,757 B2 12/2016 Boyce
9,612,023 B2 4/2017 Salpietra
9,644,862 B1 5/2017 Korte
9,681,564 B2 6/2017 Lin
9,772,117 B2 9/2017 Feisthammel et al.
9,889,397 B2 2/2018 Pfannenberg
9,901,760 B2 2/2018 Erb et al.
10,071,331 B2 9/2018 Hedlund
10,143,953 B1 12/2018 Lee et al.
D851,742 S 6/2019 Chang et al.
10,369,507 B2 8/2019 Hedlund
10,376,827 B2 8/2019 Cole
D859,631 S 9/2019 Chang et al.
10,507,416 B2 12/2019 Crabtree et al.
10,520,216 B2 12/2019 Cole
10,527,315 B2 1/2020 Cole
10,543,445 B2 1/2020 Branzelle et al.

(56) References Cited

U.S. PATENT DOCUMENTS

| | | | |
|---|---|---|---|
| 10,773,197 | B1 | 9/2020 | Bishop |
| 10,933,722 | B2 | 3/2021 | Abts |
| 10,940,417 | B1 | 3/2021 | Bishop |
| 10,960,339 | B2 | 3/2021 | Cole |
| 11,395,437 | B2 | 7/2022 | Quijano et al. |
| 2001/0053668 | A1 | 12/2001 | Berger |
| 2002/0000936 | A1 | 1/2002 | Sheen |
| 2002/0022450 | A1 | 2/2002 | Berger |
| 2003/0145568 | A1 | 8/2003 | Hodge |
| 2003/0211823 | A1 | 11/2003 | Wolf et al. |
| 2003/0226338 | A1 | 12/2003 | Yair et al. |
| 2004/0003718 | A1 | 1/2004 | Milano |
| 2004/0011202 | A1 | 1/2004 | Kiilunen |
| 2004/0074214 | A1 | 4/2004 | Henson |
| 2004/0149130 | A1 | 8/2004 | Gorchev |
| 2004/0163367 | A1 | 8/2004 | Cogar, Sr. et al. |
| 2004/0182055 | A1 | 9/2004 | Wynn |
| 2005/0091951 | A1 | 5/2005 | Moreno |
| 2005/0095979 | A1 | 5/2005 | Moreno |
| 2005/0247037 | A1 | 11/2005 | Chen et al. |
| 2005/0266791 | A1 | 12/2005 | Beliveau et al. |
| 2006/0086252 | A1 | 4/2006 | Huang |
| 2006/0096261 | A1 | 5/2006 | Zhang |
| 2006/0117726 | A1 | 6/2006 | Moreno |
| 2006/0174596 | A1 | 8/2006 | Choi et al. |
| 2007/0113527 | A1 | 5/2007 | Song et al. |
| 2007/0266685 | A1 | 11/2007 | Ferguson |
| 2008/0093269 | A1 | 4/2008 | Timmerman et al. |
| 2008/0115473 | A1 | 5/2008 | Miller |
| 2008/0229723 | A1 | 9/2008 | Stepp |
| 2009/0004022 | A1 | 1/2009 | Neibrook et al. |
| 2009/0199526 | A1 | 8/2009 | Wallace |
| 2009/0320422 | A1 | 12/2009 | Jackson et al. |
| 2009/0320426 | A1 | 12/2009 | Braunecker et al. |
| 2010/0012110 | A1 | 1/2010 | Feisthammel et al. |
| 2010/0015904 | A1 | 1/2010 | Yeh et al. |
| 2010/0101197 | A1 | 4/2010 | Livingstone et al. |
| 2010/0227545 | A1 | 9/2010 | Frois |
| 2010/0248605 | A1 | 9/2010 | Sharma et al. |
| 2010/0251893 | A1 | 10/2010 | Hamlin et al. |
| 2011/0023722 | A1 | 2/2011 | Tonelli et al. |
| 2011/0044846 | A1 | 2/2011 | Mcnally et al. |
| 2011/0225939 | A1 | 9/2011 | Loggins et al. |
| 2011/0250834 | A1 | 10/2011 | Mctaw, Jr. |
| 2012/0003914 | A1 | 1/2012 | Warner |
| 2012/0037553 | A1 | 2/2012 | Silverstein et al. |
| 2012/0124951 | A1 | 5/2012 | Miskel |
| 2012/0311978 | A1 | 12/2012 | Crabtree et al. |
| 2012/0317941 | A1 | 12/2012 | Crabtree |
| 2012/0318144 | A1 | 12/2012 | Crabtree et al. |
| 2013/0067875 | A1 | 3/2013 | Hartmann et al. |
| 2013/0097981 | A1 | 4/2013 | Harris |
| 2013/0125520 | A1 | 5/2013 | Gorman |
| 2013/0186050 | A1 | 7/2013 | Skopis |
| 2013/0199142 | A1 | 8/2013 | Kerr, Jr. |
| 2014/0000458 | A1 | 1/2014 | Ferguson |
| 2014/0273799 | A1 | 9/2014 | Erb et al. |
| 2014/0373493 | A1 | 12/2014 | Cannon |
| 2015/0128804 | A1 | 5/2015 | Salpietra |
| 2015/0238891 | A1 | 8/2015 | Hedlund |
| 2016/0216001 | A1 | 7/2016 | Szarek |
| 2017/0007951 | A1 | 1/2017 | Dechristofaro |
| 2017/0307250 | A1 | 10/2017 | Berneth et al. |
| 2018/0326819 | A1 | 11/2018 | Abts |
| 2019/0107301 | A1 | 4/2019 | Kamalpour |
| 2020/0103138 | A1 | 4/2020 | Ellis |
| 2020/0238210 | A1 | 7/2020 | Gonzalez |
| 2020/0240372 | A1 | 7/2020 | Gonzalez |
| 2020/0282352 | A1 | 9/2020 | Davidson |
| 2022/0065494 | A1 | 3/2022 | Schempp |
| 2022/0082277 | A1 | 3/2022 | Lowe |
| 2022/0233983 | A1 | 7/2022 | Carr et al. |
| 2022/0412602 | A1 | 12/2022 | Ciuricov |
| 2023/0235902 | A1 | 7/2023 | Chacon, Jr. et al. |
| 2023/0235917 | A1 | 7/2023 | Cho et al. |

* cited by examiner

TOOLLESS INSTALLATION OF VENT ASSEMBLY

TECHNICAL FIELD

This disclosure is directed generally to filtered vent registers.

BACKGROUND ART

Generally, duct end filtered vent registers are known to exist. These filtered vent registers are designed to filter the air coming through a vent register in a building or HVAC system. Currently, there are different types of filtered vent registers.

Standard register with filter: This type of vent register is similar to a standard vent register, but it includes a filter that is placed at the end of the duct. The filter is designed to capture airborne particles such as dust, pollen, and pet dander.

Hinged filter register: This type of vent register includes a hinged filter that can be easily opened and closed for filter replacement. The filter is placed at the end of the duct, and the hinged cover allows easy access for filter changes. One exemplary hinged filter register is taught in U.S. Pat. No. 6,942,710.

Side loading filter register: This type of vent register includes a filter that is loaded from the side of the register rather than the end. This allows for easy filter replacement without having to remove the entire vent register from the wall or ceiling.

Disposable filter register: This type of vent register includes a disposable filter that is designed to be replaced on a regular basis. The filter is typically made of a disposable material such as fiberglass or polyester, and it can be easily replaced when it becomes clogged with airborne particles.

Permanent filter register: This type of vent register includes a permanent filter that is designed to last for the life of the register. The filter is typically made of a washable material such as foam or mesh, and it can be easily cleaned and reused.

Overall, duct end filtered vent registers are an important component of HVAC systems that help to improve indoor air quality by capturing airborne particles before they are circulated through the building. The specific type of vent register used will depend on the specific needs of the building or HVAC system.

Screwing air vent registers into a wall can have several disadvantages, including (1) damage to the wall: Screw holes can damage the wall or ceiling where the register is installed. This can make it difficult to patch or repair the wall if the register needs to be removed in the future. (2) Installation time: Screwing in air vent registers can be time-consuming, especially if multiple registers need to be installed. This can lead to longer installation times and higher labor costs. (3) Safety concerns: If the screws are not installed properly, they may become loose over time and pose a safety hazard. Loose screws can cause the air vent register to fall off the wall or ceiling, potentially injuring someone below.

SUMMARY OF THE INVENTION

Although the foregoing types of filtered vent registered are known, there is still room for improvement. For example, with respect to hinged registers with a filter, there is a need to improve their manufacture by providing easy installation. For example, some users that live in apartments may not be allowed to drill or screw items into a wall. For others, they may have difficulty using these tools, such as a drill or screw. Thus, what is needed is an improved filtered vent register that enables toolless installation thereof. The present disclosure addresses this issue amongst others.

A clip connector that provides a snap-in configuration to effectuate a toolless installation of the air vent register may be better, safer, faster, more efficient, and lower cost than using screws to install the air vent register. A snap-in connector can be installed quickly and easily without the need for tools or screws. This can save time and reduce installation costs. Since a snap-in connector does not require screws or tools, less labor is needed for installation. This can help lower installation costs. A snap-in connector is less likely to come loose or pose a safety hazard than screws that may loosen over time. A snap-in connector does not require screw holes, which can reduce the risk of wall damage and make it easier to remove or replace the air vent register in the future.

In one aspect, an exemplary embodiment of the present disclosure may provide an air vent apparatus comprising: a vent housing body defining comprising a first sidewall and a second sidewall that define a longitudinal direction therebetween, a top wall and a bottom wall that define a vertical direction therebetween, and a front surface and a rear surface that define a transverse direction therebetween, wherein the vent hosing body defines an air passageway that extends between at least a first open end and a second open end; and at least one clip connector attached to the rear surface of the vent housing body, wherein the clip connector provides a snap-in attachment of the vent housing body to one of a wall and an air duct to align the air passageway with the air duct to effectuate a toolless installation of the air vent apparatus. This embodiment or another exemplary embodiment may further provide that the at least one clip connector includes an upper clip connector attached to the top wall of the vent housing body. This embodiment or another exemplary embodiment may further provide that the upper clip connector is centered on the top wall between the first sidewall and the second sidewall. This embodiment or another exemplary embodiment may further provide a T-shaped member on the upper clip connector; and a slot formed in the top wall of the vent housing body, wherein the T-shaped member couples with the slot to attach the upper clip connector to the vent housing body. This embodiment or another exemplary embodiment may further provide a clip arm of the upper clip connector, wherein the clip arm extends rearward in the transverse direction in a cantilevered manner from the rear surface of the vent housing body to a terminal end of the clip arm. This embodiment or another exemplary embodiment may further provide an upwardly facing surface on the clip arm of the upper clip, wherein the upwardly facing surface tapers from an edge to the terminal end. This embodiment or another exemplary embodiment may further provide a ledge on the clip arm of the upper clip connector that is located below the edge of the upwardly facing surface, wherein the ledge is located between the T-shaped member and the terminal end, wherein the ledge is configured to engage one of the wall and the air duct after the toolless installation of the vent housing body. This embodiment or another exemplary embodiment may further provide a first lower clip connector attached to the bottom wall of the vent housing body. This embodiment or another exemplary embodiment may further provide a second lower clip connector attached to the bottom wall of the vent housing body, and the second lower clip connector is spaced apart from the first lower clip relative to the longitudinal direction. This embodiment or another exemplary embodiment may further provide that the first lower clip connector and the second lower clip connector are on opposite sides of a center of the bottom wall. This embodiment or another exemplary embodiment may further provide that the first lower clip includes an end member on the first lower clip connector that is configured to be received by a portion of the bottom wall of the vent housing body. This embodiment or another exemplary embodiment may further provide that the portion of the lower wall of the vent housing body that receives the end member on the first lower clip connector is a C-shaped channel, wherein the end member is shaped complementary to the C-shaped channel. This embodiment or another exemplary embodiment may further provide a slot formed in the bottom wall of the vent housing body, wherein the slot receives a clip arm on the first lower clip. This embodiment or another exemplary embodiment may further provide a louvered grill having a hinge flange, wherein the slot also receives the hinge flange on the grill that to hingedly connect the grill to the vent housing body. This embodiment or another exemplary embodiment may further provide a clip arm of the first lower clip connector, wherein the clip arm extends rearward in the transverse direction in a cantilevered manner from the rear surface of the vent housing body to a terminal end of the clip arm. This embodiment or another exemplary embodiment may further provide an downwardly facing surface on the clip arm of the first lower clip connector, wherein the downwardly facing surface tapers from an edge to the terminal end. This embodiment or another exemplary embodiment may further provide a ledge on the clip arm of the first lower clip connector that is located above the edge of the downwardly facing surface, wherein the ledge is located between an end member and the terminal end, wherein the ledge is configured to engage one of the wall and the air duct after the toolless installation of the vent housing body. This embodiment or another exemplary embodiment may further provide a first clip connector attached to one of the top wall, the bottom wall, the first sidewall, or the second sidewall of the vent housing body; a second clip connector attached to another one of the top wall, the bottom wall, the first sidewall, or the second sidewall of the vent housing body; and wherein the first clip connector and the second clip connector provide a snap-in engagement to one of the wall and the air duct in the toolless installation of the vent housing body; and a louvered grill hingedly attachable to the front surface of the vent housing body. This embodiment or another exemplary embodiment may further provide a filter that is selectively and removably positioned between the louvered grill and the vent housing body. This embodiment or another exemplary embodiment may further provide a plate that is selectively and removably positioned between the louvered grill and the vent housing body when the filter is removed, wherein the plate is operable to prevent or impede airflow through the louvered grill.

In yet another aspect, an exemplary embodiment of the present disclosure may provide a method for an air vent apparatus, the method comprising moving a vent housing body toward an opening defined in a wall, wherein the opening is in communication with an air duct; connecting the vent housing body to one of the wall and the air duct via a toolless installation; hingedly connecting a grill to the vent housing body; and disposing a filter between the grill and the vent housing body. This embodiment or another exemplary embodiment may further include hingedly opening the grill relative the vent housing body while the vent housing body remains connected one of the wall and the air duct, wherein the filter remains in the vent housing body when the grill is hinged open. This embodiment or another exemplary embodiment may further include removing the filter form the vent housing body when the grill is hinged open. This embodiment or another exemplary embodiment may further include installing a plate in the vent housing body in a space previously occupied by the filter after having removed the filter, wherein the plate is operable to preclude or inhibit air flow through the grill. This embodiment or another exemplary embodiment may further include maintaining the filter stationary as the grill is hinged open. This embodiment or another exemplary embodiment may further include maintaining a height dimension of the filter parallel to a vertical direction as the filter remains stationary as the grill is hinged open, wherein the height dimension of the filter is less than a length dimension of the filter and greater than a thickness dimension of the filter. This embodiment or another exemplary embodiment may further provided that the toolless installation of the vent housing body to one of the wall and the air duct is effectuated by a clip connector. This embodiment or another exemplary embodiment may further provide that the clip connector comprises a clip arm that extends rearward in a cantilevered manner from a rear surface of the vent housing body. This embodiment or another exemplary embodiment may further include moving a terminal end of the clip arm through the opening in the wall that is aligned with the air duct; contacting a tapered surface of the clip arm with an edge of the wall that defines the opening; and flexing the clip arm from a neutral position to a flexed position in response to the vent housing body moving toward the wall. This embodiment or another exemplary embodiment may further include moving the tapered surface of the clip arm to a location behind the wall, wherein when the tapered surface is located behind the wall the clip arm returns to the neutral position. This embodiment or another exemplary embodiment may further provide that the clip connector establishes a snap-fit configuration that connects the vent housing body to the wall without the use of screws, a screwdriver or a drill. This embodiment or another exemplary embodiment may further provide that the toolless installation of the vent housing body to one of the wall and the air duct is effectuated by a plurality of clip connectors. This embodiment or another exemplary embodiment may further include attaching at least one clip connector from the plurality of clip connectors to the vent housing body via a T-shaped member on the at least one clip connector. This embodiment or another exemplary embodiment may further include inserting a portion of the T-shaped member through a slot formed in the vent housing body. This embodiment or another exemplary embodiment may further provide that the slot is formed in a top wall of the vent housing body. This embodiment or another exemplary embodiment may further provide that the slot is a single slot formed in the top wall of the vent housing body and the single slot is located centrally between two sidewalls of the vent housing body. This embodiment or another exemplary embodiment may further include attaching at least one clip connector to the vent housing body via an end member on the at least one clip connector. This embodiment or another exemplary embodiment may further provide that the end member is shaped complementary to and received within a perimeter channel formed in a rear surface of the vent housing body. This embodiment or another exemplary embodiment may further include inserting a portion of the at least one clip through a slot formed in the vent housing body when the end member is disposed within the perimeter channel.

BRIEF DESCRIPTION OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

A vent register or a filtered air vent apparatus is shown in some of the figures as register or apparatus 10. Apparatus 10 is configured to be mounted on a wall 12 or floor of a structure, such as a building or home, and align with an air duct 14 or air return duct, which may be in the wall 12 or in the floor.

Figure 1:
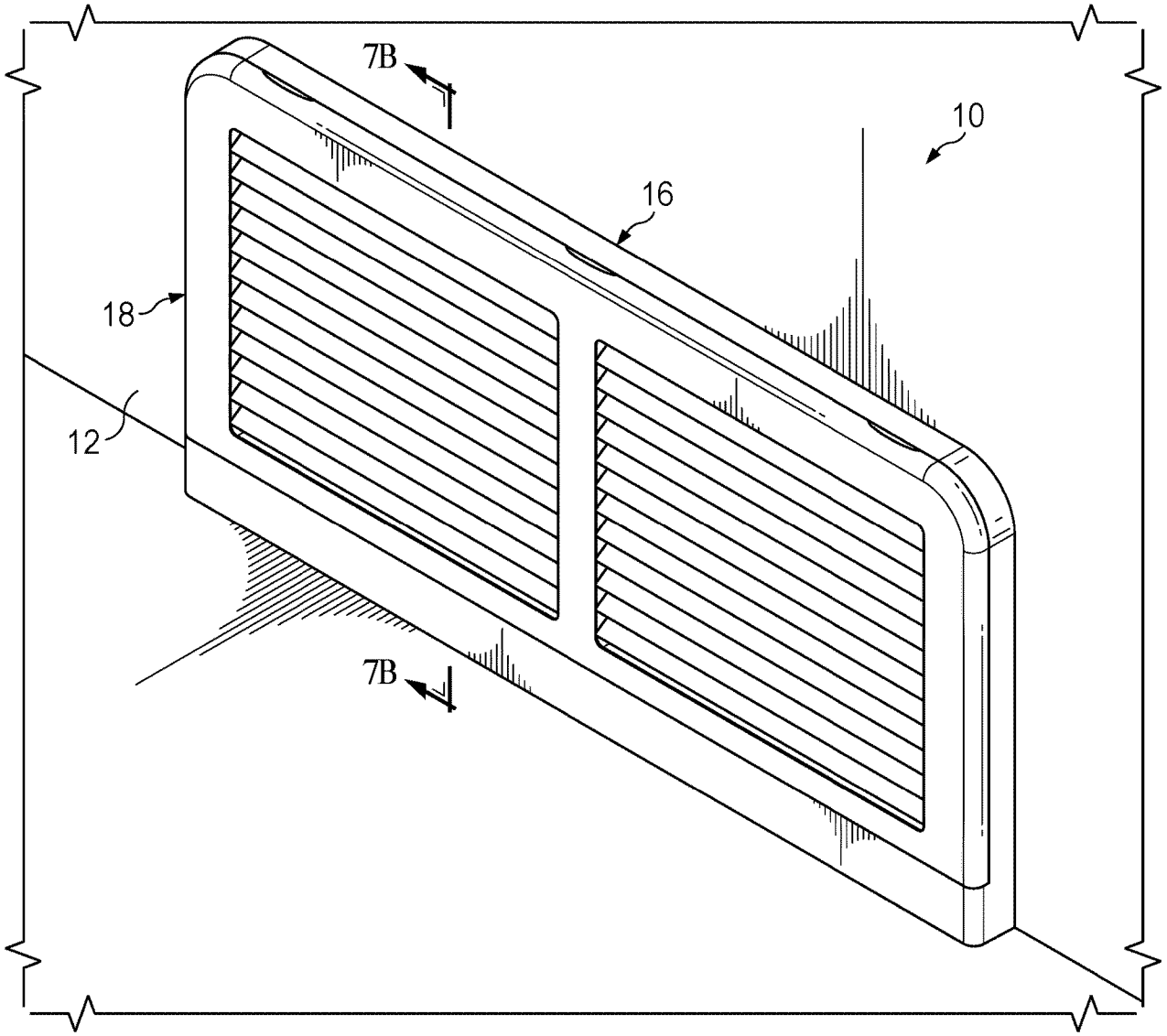
FIG. 1 (FIG. 1) is an environmental perspective view of a filtered air vent apparatus according to one aspect of the present disclosure, the filtered air vent apparatus shown mounted on a wall at the terminal opening of an air duct (not shown).
Figure 2:
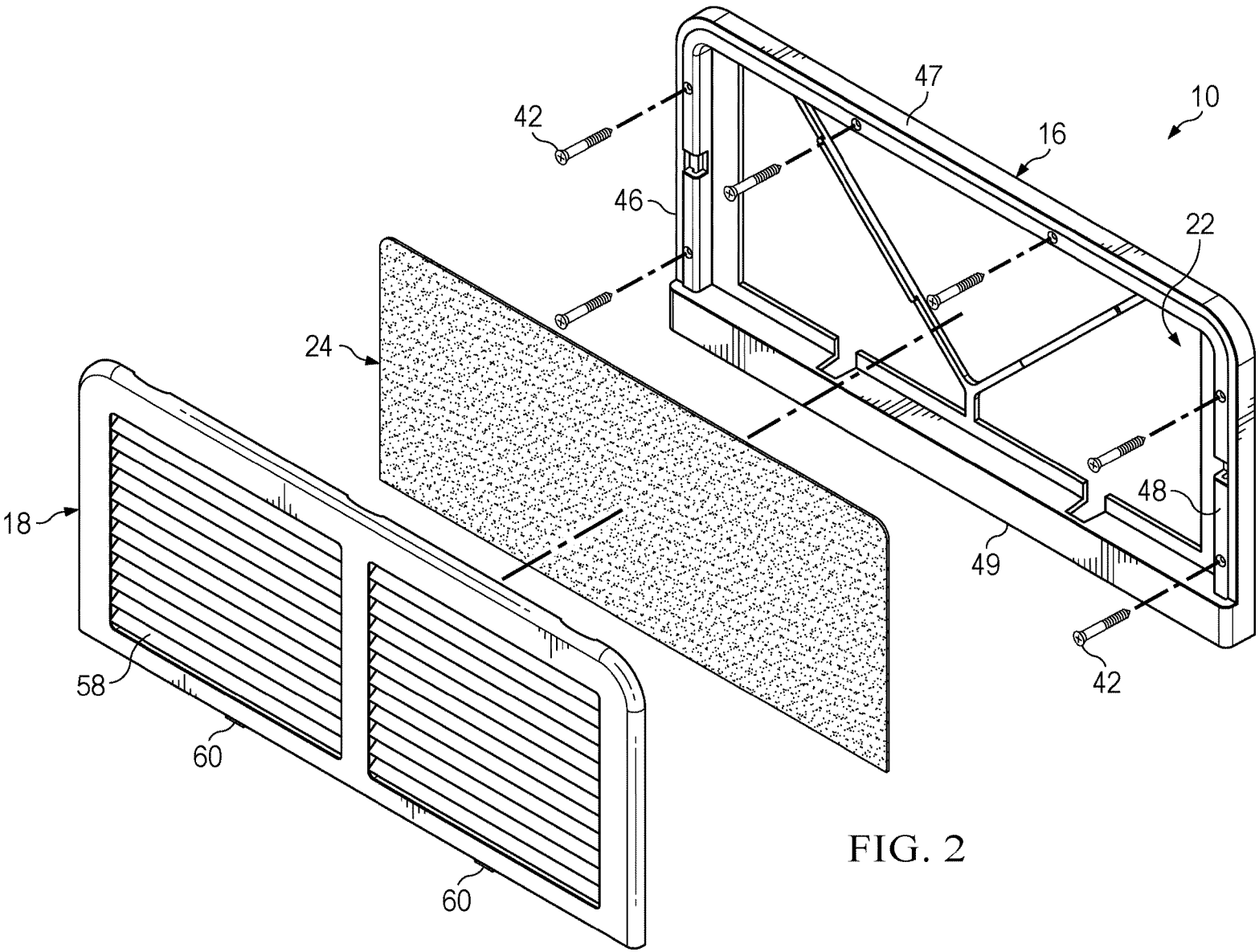
FIG. 2 (FIG. 2) is an exploded perspective view of the filtered air vent apparatus of FIG. 1.
Figure 3:
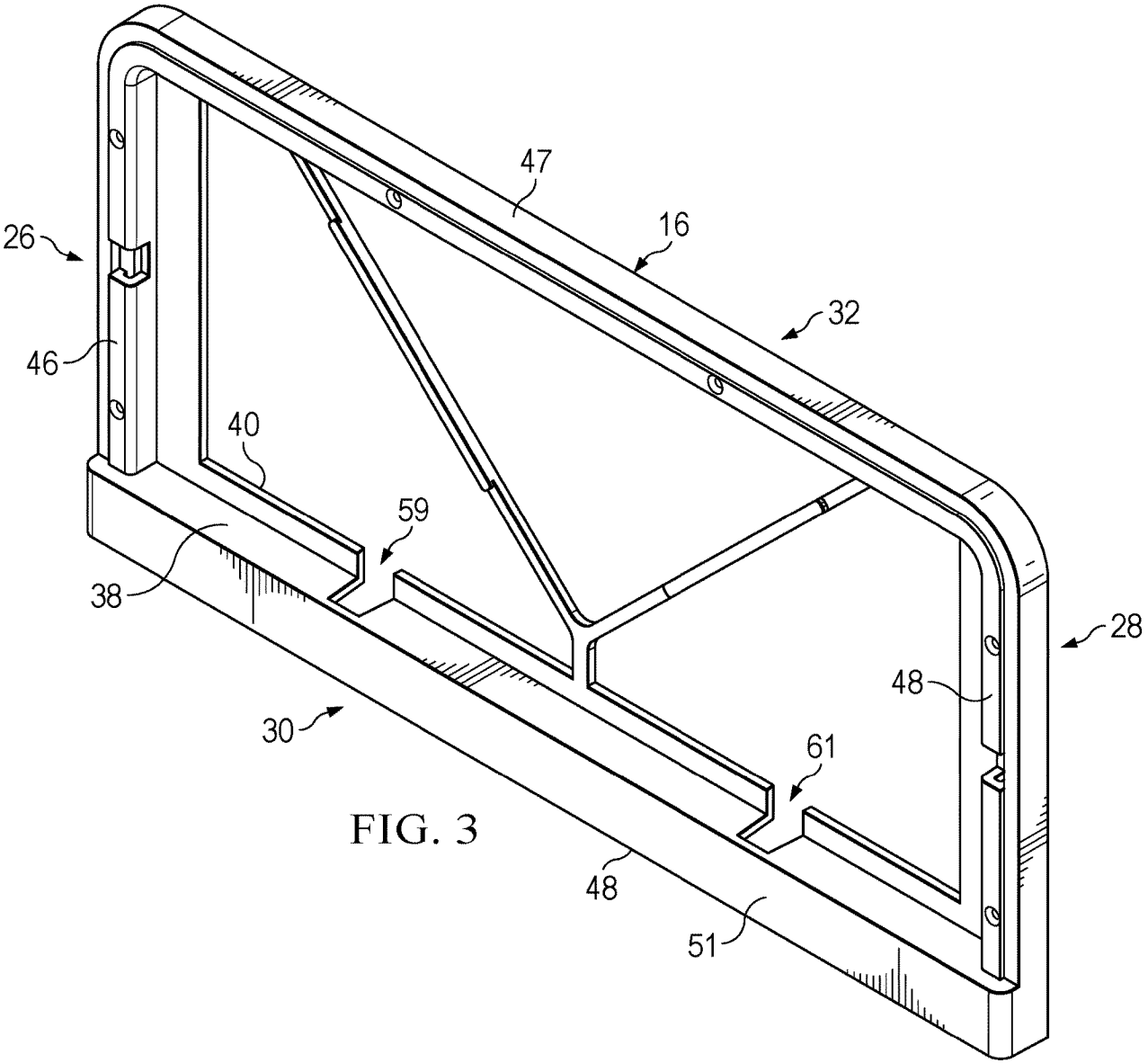
FIG. 3 (FIG. 3) is a front perspective view of a vent housing body of the filtered air vent apparatus.
Figure 4A:
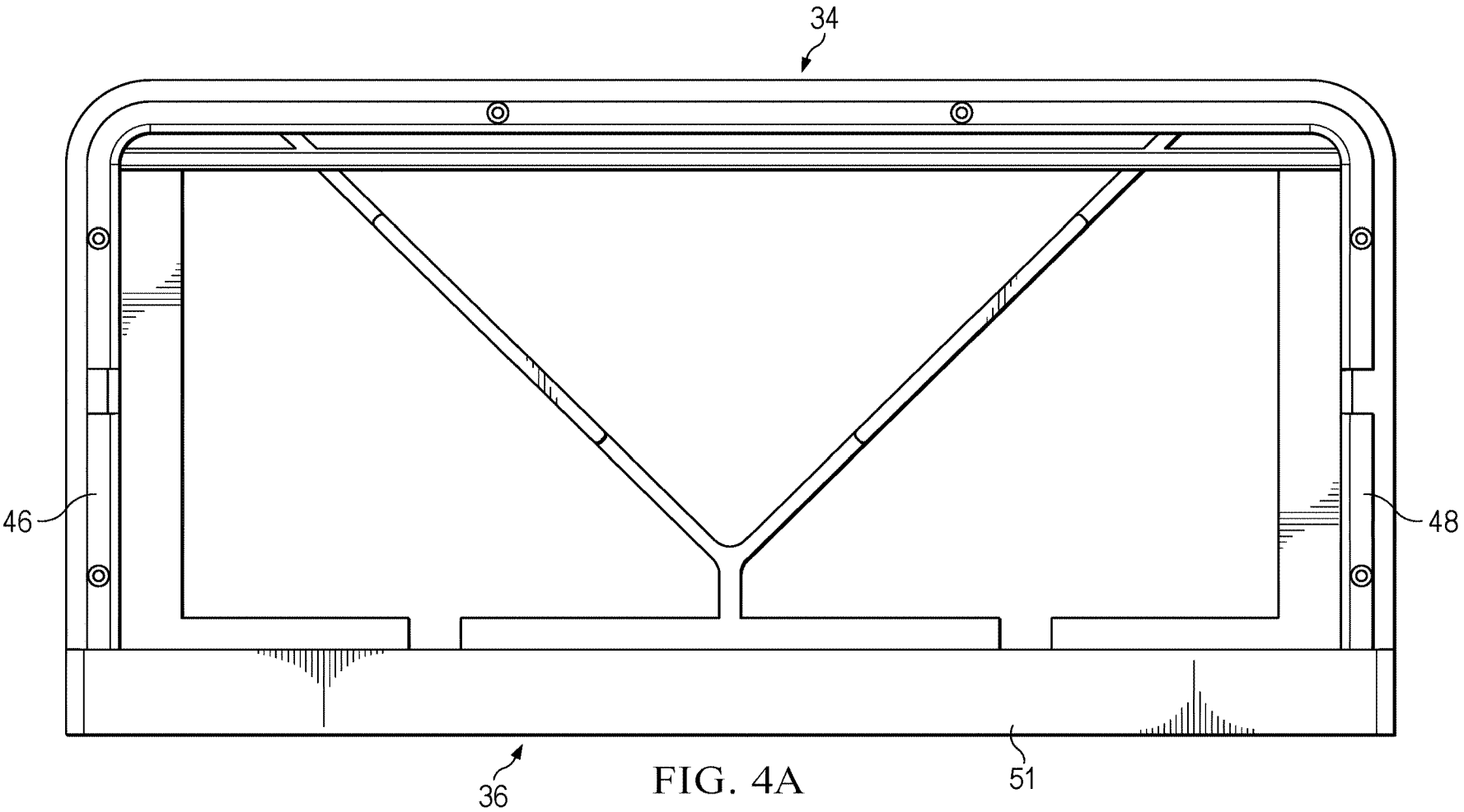
FIG. 4A (FIG. 4A) is a front elevation view of the vent housing body of the filtered air vent apparatus.
Figure 4B:
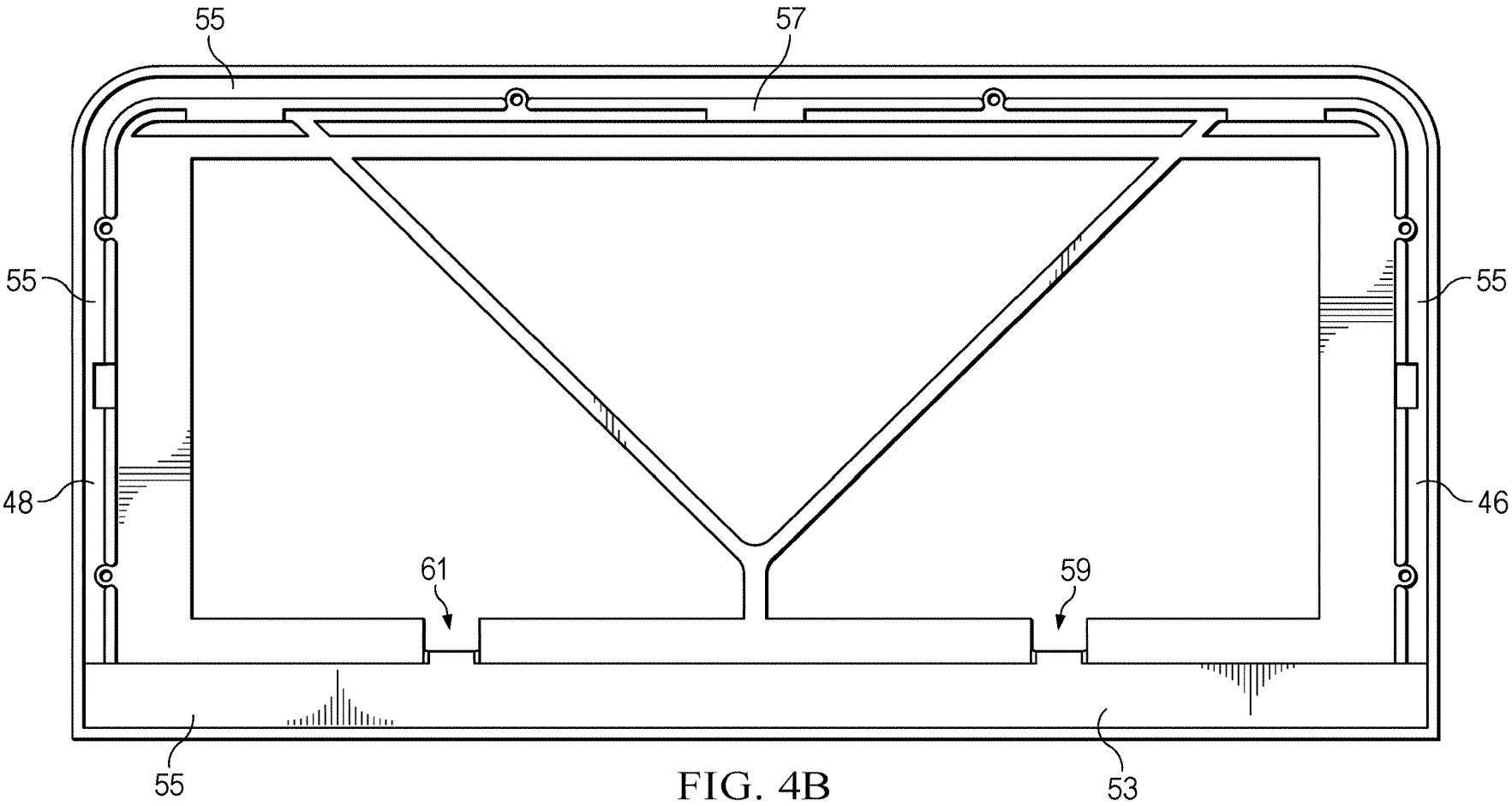
FIG. 4B (FIG. 4B) is a rear elevation view of the vent housing body of the filtered air vent apparatus.

FIG. 1 and FIG. 2 depict one exemplary embodiment of the apparatus 10 that includes a vent housing body 16, a louvered grill 18 hingedly attachable to the vent housing body 16 and securable to the vent housing body 16 in a snap fit configuration. Housing body 16 defines an air passageway 22 that extends from an open first end to an open second end. A filter 24 that is selectively and removably positioned behind the grill 18 and in the air passageway 22.

FIG. 2 through FIG. 4B depict that the vent housing body 16 may include a first side 26 opposite a second side 28 defining a longitudinal direction therebetween. The housing body 16 includes a front end 30 and a rear end 32 defining a transverse direction therebetween. The housing body includes a top or upper end 34 opposite a bottom or lower end 36 defining a vertical direction therebetween. The housing body 16 defines the air passageway 22 that extends between at least a first open end 38 near the front end 30 and a second open end 40 near the rear end 32 of the housing body 16. In one embodiment, the rear end 32 of the housing body 16 mounts to the wall 12 of the structure via fasteners 42 that extend transversely through body 16. The rear surface of body 16 lies flush against wall 12. When mounted, the air passageway 22 aligns with the air duct 14. In other embodiments, discussed in greater detail herein, a vent apparatus is provide that does not utilize fasteners 42, but instead uses clips, to install the housing body 16 on the wall 12 such that the clips permit toolless installation of the apparatus on the wall 12.

The housing body 16 may be formed as a unibody monolithic member, however the body could also be formed as distinct components that are connected together. The body 16 may be a unibody that is integrally extruded, molded, printed, or additively manufactured, removably machined, or formed as a unitary, monolithic member substantially fabricated from a rigid, manmade, material. In one example, the body 16 may be formed from a generally rigid polymer material that withstands deformation in operation as a vent register. In one example, metal or metal alloys, such as stainless steel or aluminum alloy, may form a substantial majority of the components or elements used to fabricate the body 16 and the various components integrally formed, molded, or extruded therewith. While it is contemplated that the body 16 and its additional components described herein are uniformly and integrally extruded, molded, or formed, it is entirely possible that the components of the tool body be formed separately from alternative materials as one having routine skill in the art would understand. Furthermore, while the components of the body 16 are discussed below individually, it is to be clearly understood that the components and their corresponding reference elements of the body 16 are portions, regions, or surfaces of the body and all form a respective element or component of the unitary body 16. Thus, while the components may be discussed individually and identified relative to other elements or components of the tool body, in this exemplary embodiment, there is a single body 16 having the below described portions, regions, or surfaces.

Housing body 16 includes a first sidewall 46 and a second sidewall 48. Housing body 16 includes a top wall 47 and a bottom wall 49. There is a front surface 51 and a rear surface 53. The first and second sidewalls 46, 48, the top wall 47, and the bottom wall 49 define a portion of the air passageway 22. The top wall 47 and bottom wall 49 extend longitudinally between the first and second sidewalls 46, 48. A perimeter channel 55 is formed in the rear surface 53 of the first and second sidewalls 46, 48, the top wall 47, and the bottom wall 49. The perimeter channel 55 is configured to receive portions of connector clips therein as will be described in greater detail herein. In one embodiment, the perimeter channel 55 is a C-shaped channel. Further, while the term perimeter is used herein to describe channel 55, it is not necessary that the channel surround the entire perimeter of housing body 16. As such, channel 55 may be a partial-perimeter channel.

The top wall 47 defines a slot 57 (seen in FIG. 4B) in the rear surface thereof. The slot 57 is located centrally between the first sidewall 46 and the second sidewall 48. The slot 57 is formed in one of the segments defining the perimeter channel 55 in the top wall 47. In one embodiment, the slot 57 has a length, measured in the longitudinal direction, that is approximately 1.25 inches.

The bottom wall 49 defines a first lower slot 59 and a second lower slot 61 in the rear surface thereof. The first lower slot 59 and the second lower slot 61 are located on opposing sides of a center axis, wherein the central axis is located centrally between the first sidewall 46 and the second sidewall 48. The first lower slot 59 is formed in one of the segments defining the perimeter channel 55 in the bottom wall 49, and the first lower slot 59 is located closer to the first sidewall 46 than the second sidewall 48. The second lower slot 61 is formed in one of the segments defining the perimeter channel 55 in the bottom wall 49, and the second lower slot 61 is located closer to the second sidewall 48 than the first sidewall 46. In one embodiment, the slots 59, 61 have a length, measured in the longitudinal direction, that is approximately 0.75 inch.

Figure 5:
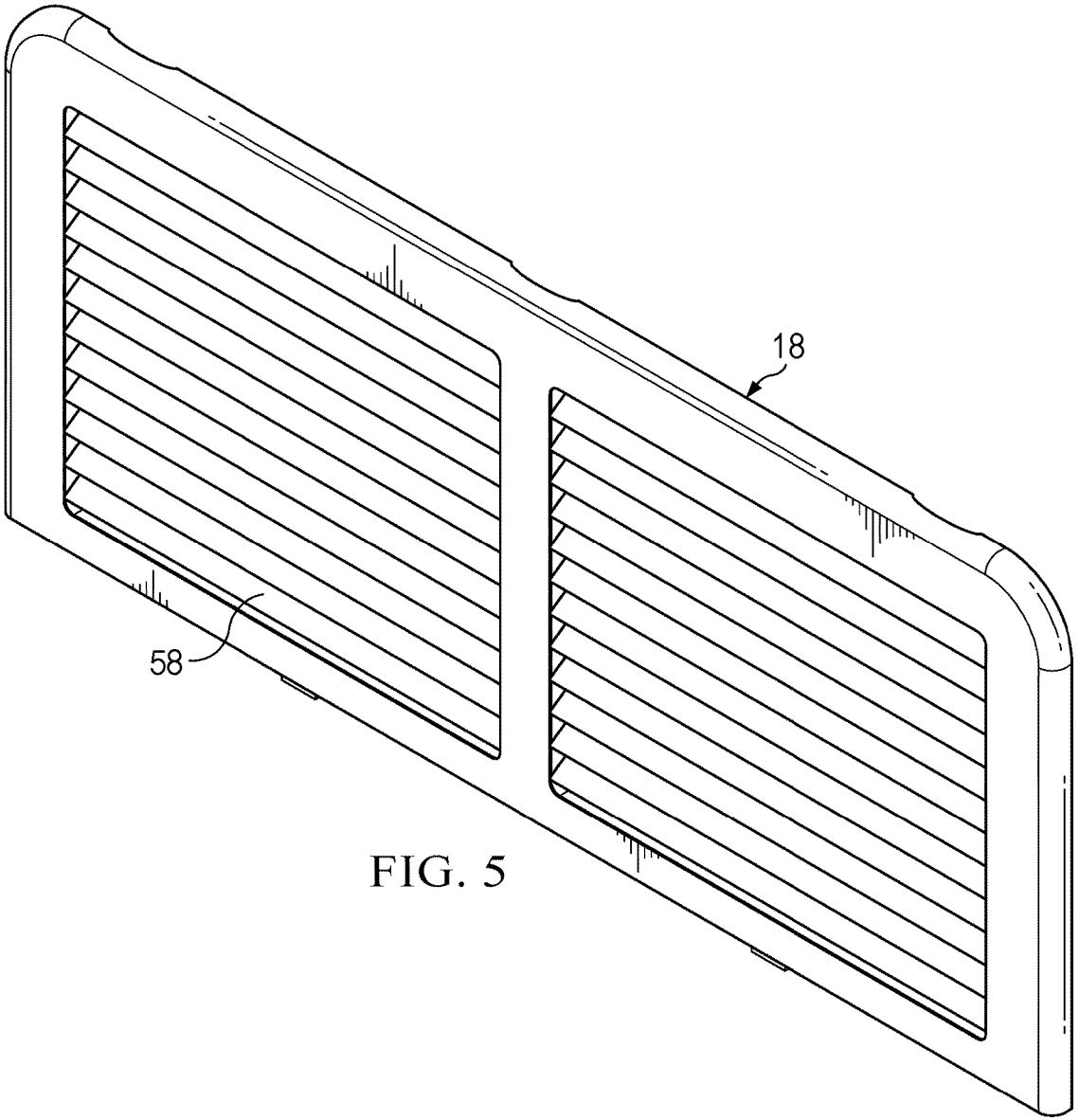
FIG. 5 (FIG. 5) is a front perspective view of a grill of the filtered air vent apparatus.
Figure 6A:
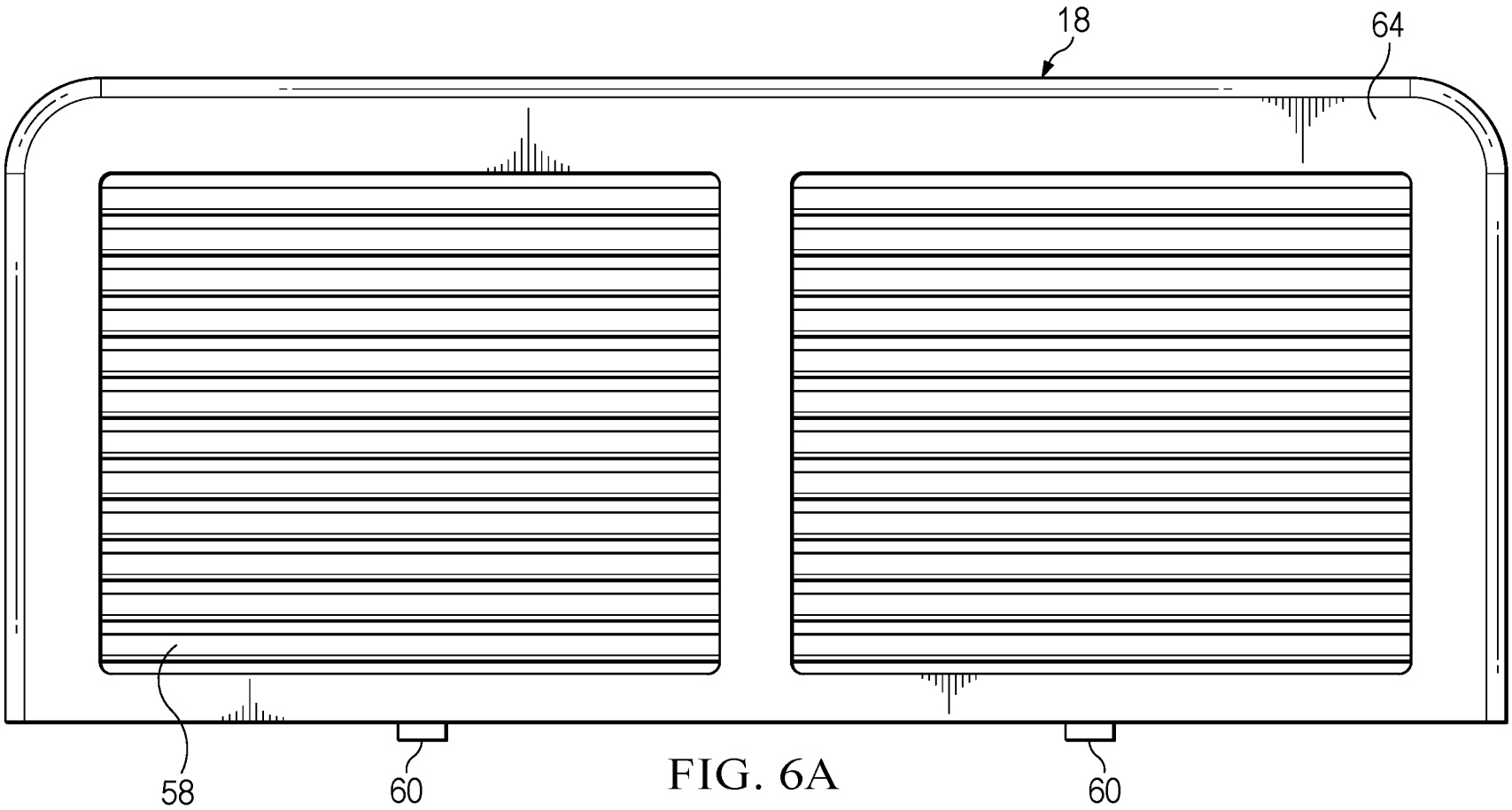
FIG. 6A (FIG. 6A) is a front elevation view of the grill of the filtered air vent apparatus.
Figure 6B:
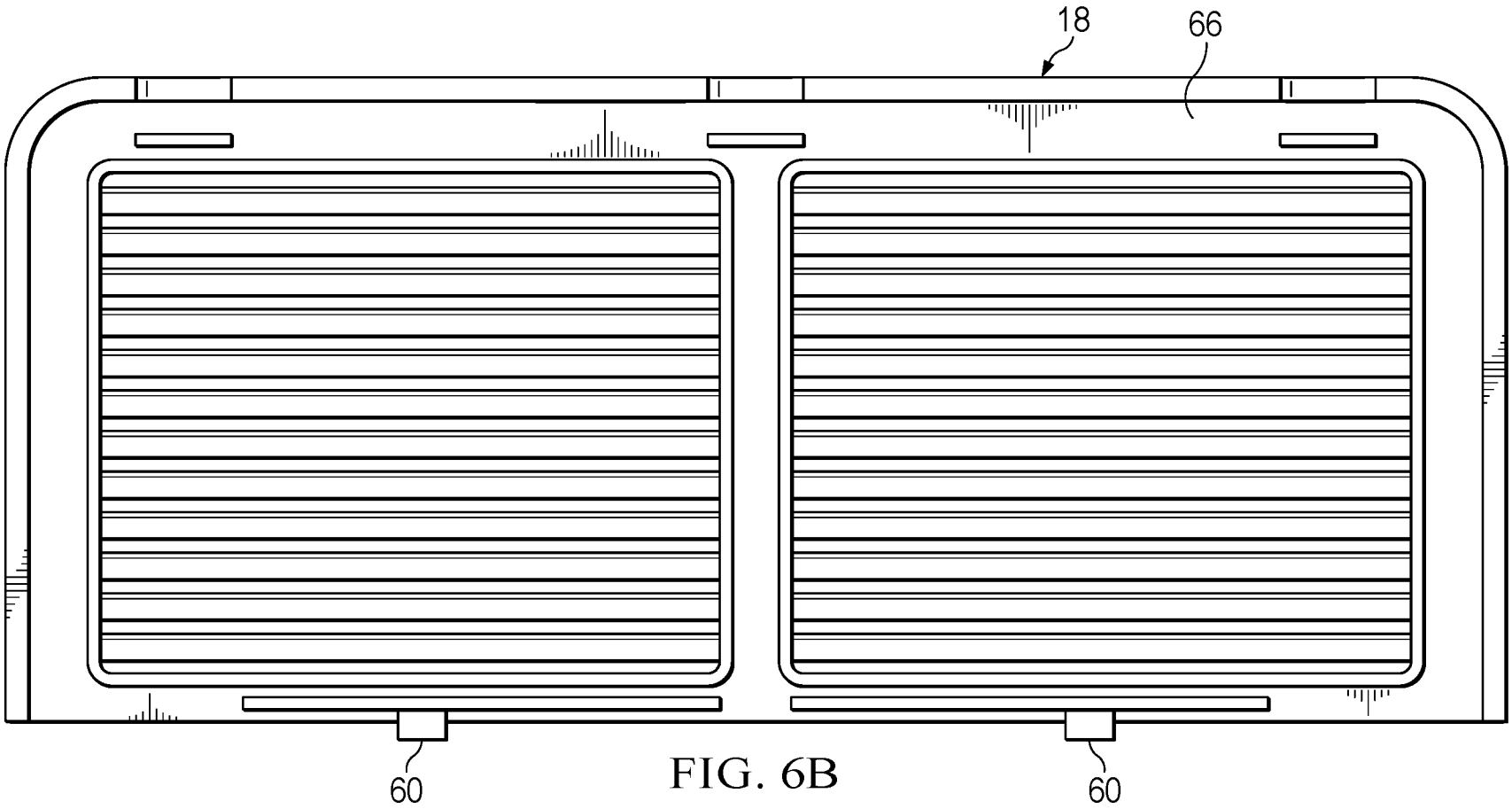
FIG. 6B (FIG. 6B) is a rear elevation view of the grill of the filtered air vent apparatus.

FIG. 2 and FIG. 5.-FIG. 6B depict that the grill 18 is a louvered grill having louvers 58 or slats that define openings therebetween that are in fluid communication with air passageway 22. Grill 18 pivotably or hingedly attaches to the vent housing body 16 via hinge flanges 60 which are accepted by the first and second lower slots 59, 61 on the vent housing body that operate as corresponding hinge notches for the flanges 60. The grill 18 includes a front surface 64 and a rear surface 66. When apparatus 10 is assembled, the rear surface 66 of the grill 18 is spaced apart from the filter 24. The rear surface 66 of the grill is free of or otherwise does not include any feature or element that retains the filter 24. Stated otherwise, there is no bezel on the rear surface 66 of the grill 18 such as what was previously taught in U.S. Pat. No. 6,942,710. Stated otherwise, the filter 24 is independent from the grill 18 and the two can move independently of each other. For example, because the filter 24 is not connected to the grill 18, the filter 24 is able to remain stationary within the air passageway 22 when the grill is selectively moved between an open first position and a closed second position by pivoting the grill 18 relative to body 16 via the hinges. When the grill 18 is moved to the closed second positon, the grill 18 is then selectively attached affixed to the vent housing bod 16*y* by snap-fit or frictional-interference fit flanges or components.

Figure 7A:
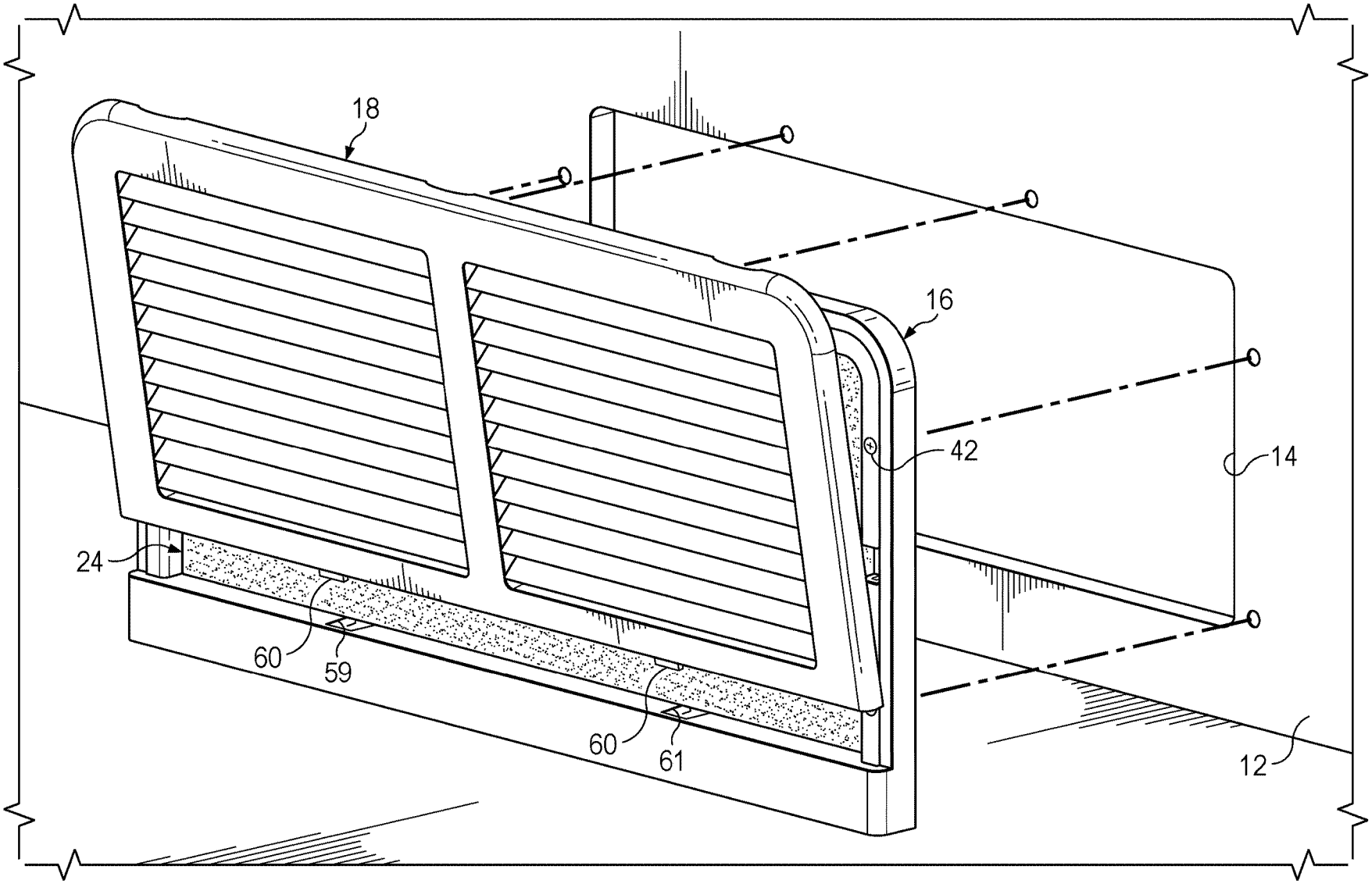
FIG. 7A (FIG. 7A) is a partially exploded operational front perspective view of connecting the grill to the vent housing body for installation on a wall.

FIG. 7A depicts that the grill 18 is moveable between a first position and a second position relative to vent housing body 16. To install the grill 18 on the body 16, the grill may be lowered to connect hinge flanges 60 with slots 59, 61. The hinged connection enables the grill 18 to pivot about a longitudinal pivot axis. This pivoting action of grill 18 allows the grill to open (i.e., a first position) and close (i.e., a second position). The embodiment of FIG. 7A depicts that fasteners 42 can be used to connect housing body 16 to wall 12. As such, this embodiment would require a tool, such as a screwdriver, to install apparatus 10 on the wall 12. However, as will be shown in further details herein, other embodiments permit toolless installation. Stated otherwise, when clip connectors are utilized instead of the fasteners 42, the apparatus may be installed on the wall 12 without the need for a tool, such as a screwdriver or drill, to effectuate the installation of apparatus 10.

Figure 7B:
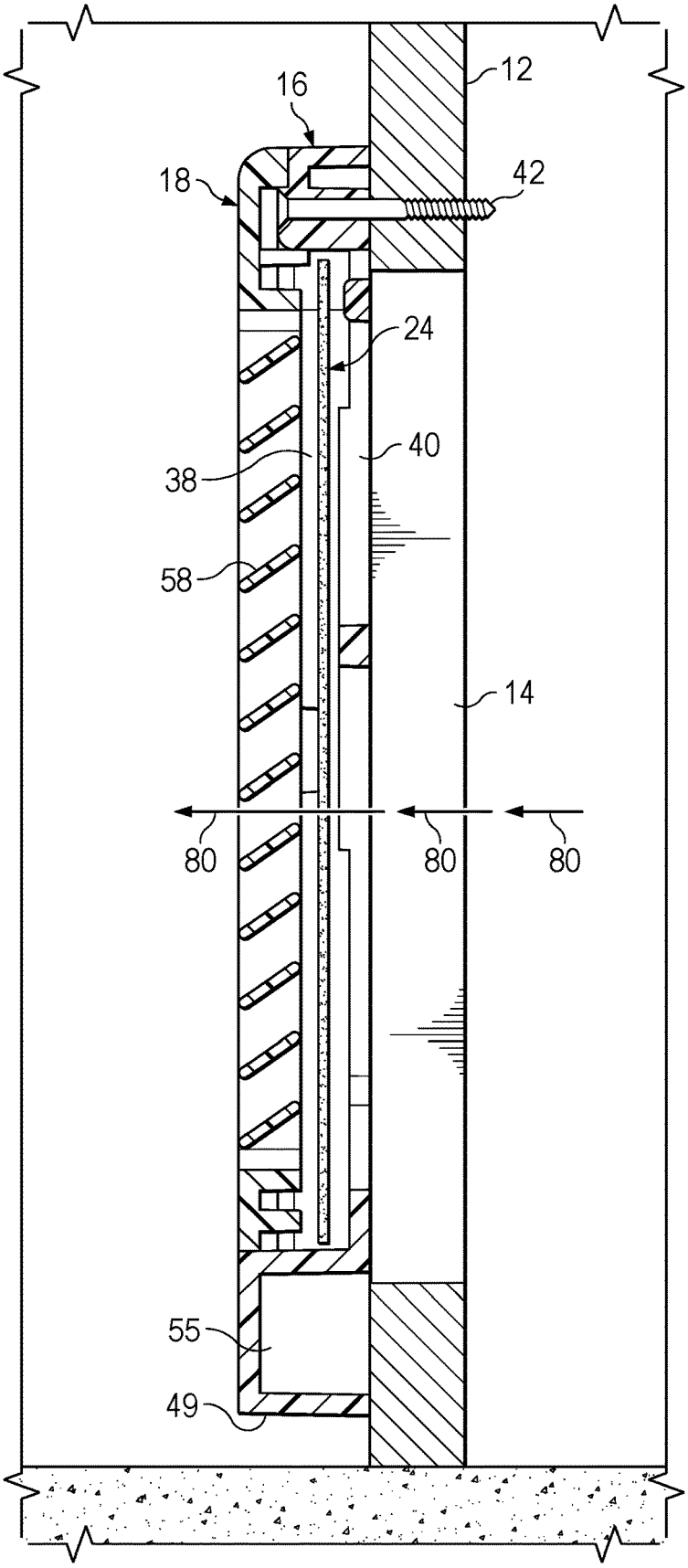
FIG. 7B (FIG. 7B) is a transverse cross section view of the filtered air vent apparatus taken along line 7B-7B in FIG. 1.
Figure 7C:
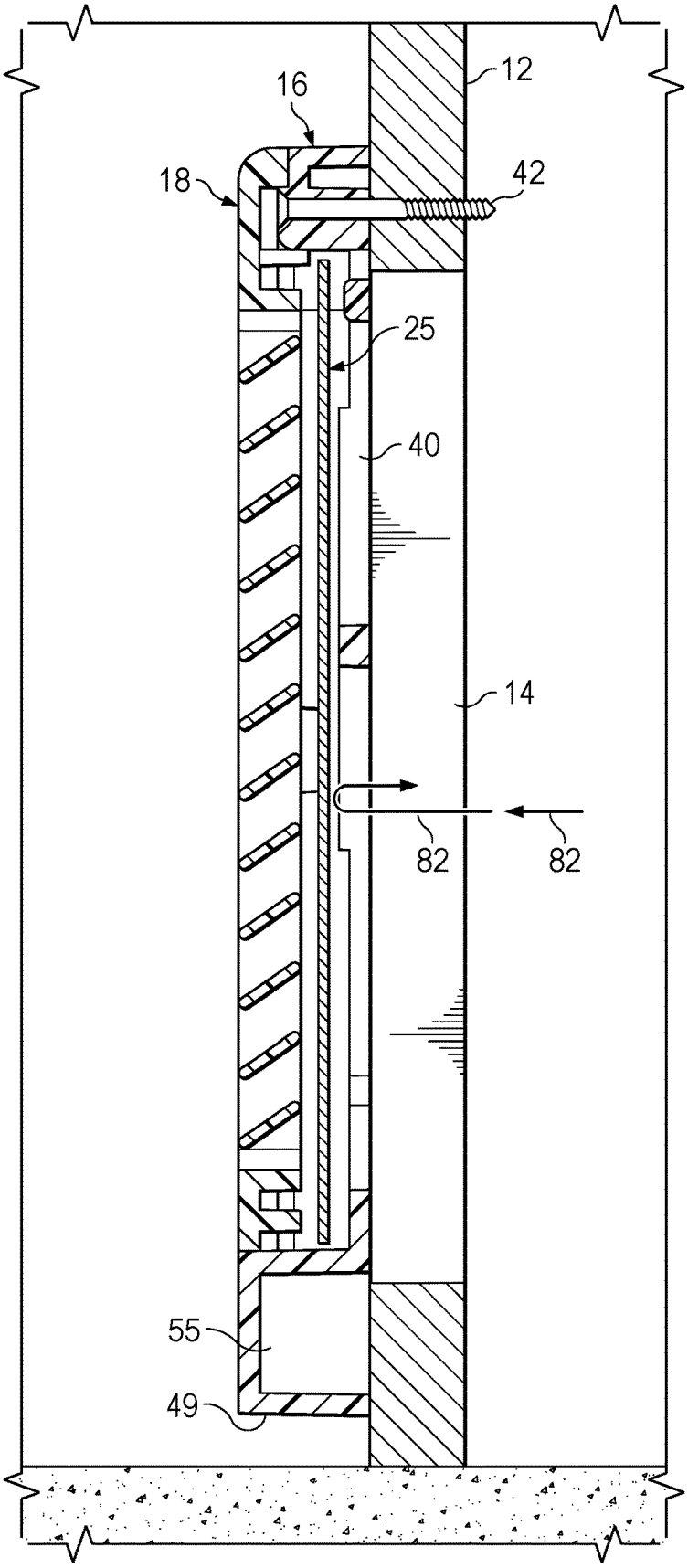
FIG. 7C (FIG. 7C) is a transverse cross section view of the filtered air vent apparatus with a plate positioned within the air passageway to block or impede air flow from the duct.
Figure 8:
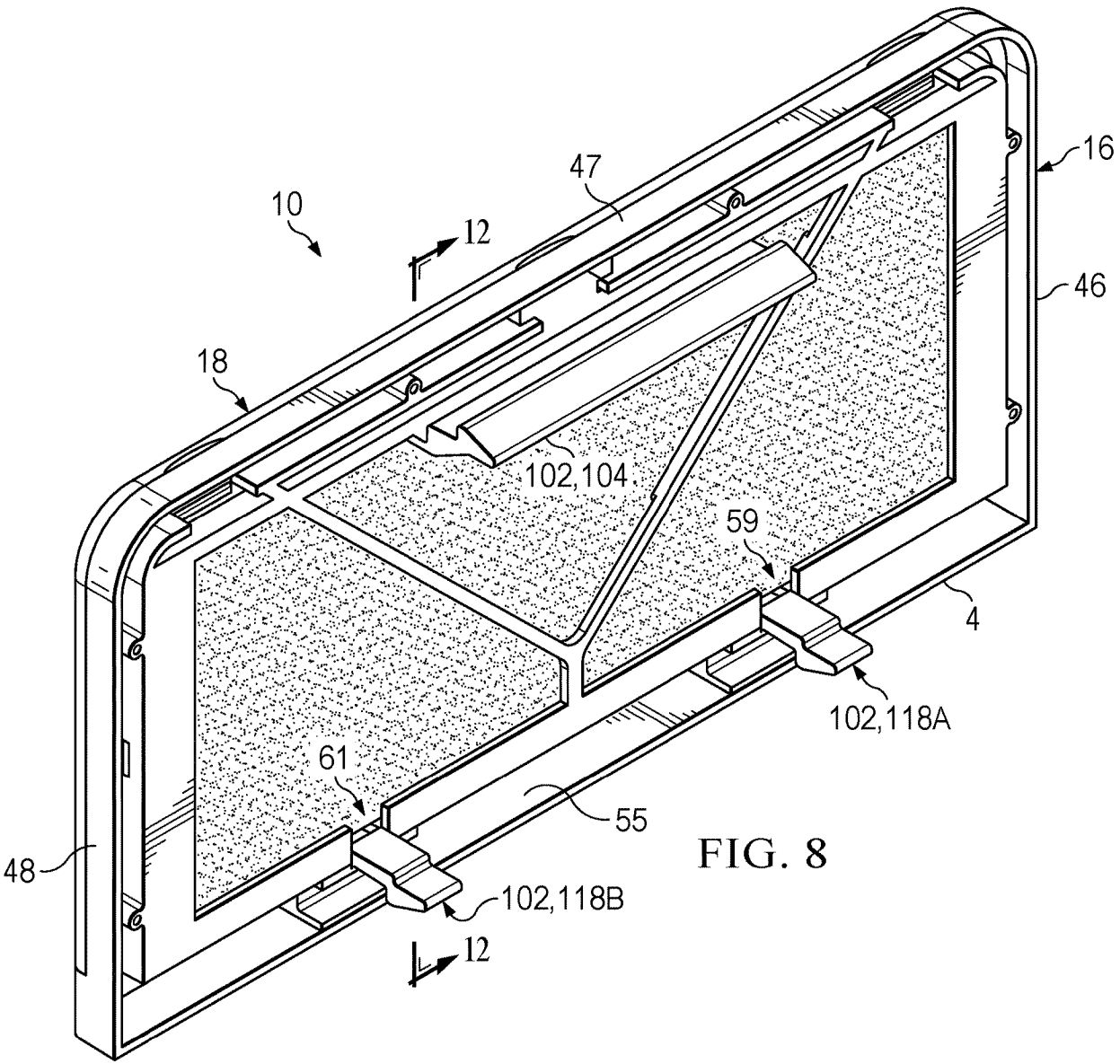
FIG. 8 (FIG. 8) is a rear perspective view of the vent housing body according to another embodiment of the present disclosure that permits or enables toolless installation of the vent housing body via at least one connector clip.

FIG. 7B and FIG. 7C depict that apparatus can be utilized in two modes. Namely, there is a first mode of the apparatus 10 (arranged as shown in FIG. 7B), wherein the first mode permits air to flow through the duct 14, through the filter 24, and out through the grill 18, as indicated by arrows 80. Filter 24 may comprise a filtering substrate with a spray-on antimicrobial coating. One exemplary filter substrate is commercially known as POLYSORB form Duraflow Industries. The substrate may be sprayed with an antimicrobial coating to result in a filter 24 with an antimicrobial disinfectant. One exemplary spray-on coating is the Pro-Tech Antimicrobial Disinfectant. Another exemplary filter with antimicrobial coating is taught in U.S. Pat. No. 7,942,957.

Figure 9:
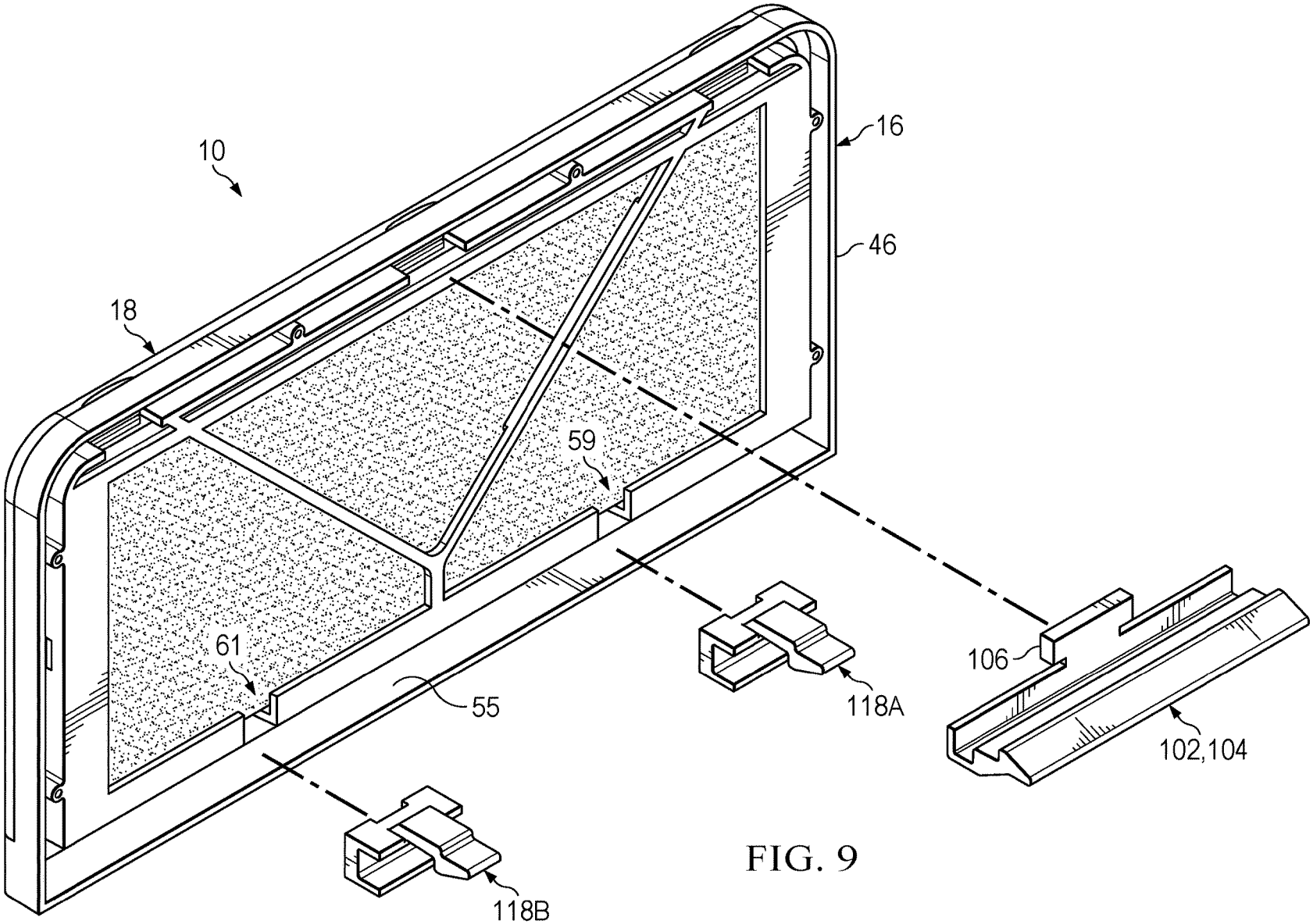
FIG. 9 (FIG. 9) is an exploded rear perspective view of the vent housing body of FIG. 8 that permits or enables toolless installation of the vent housing body via at least one connector clip.
Figure 10A:
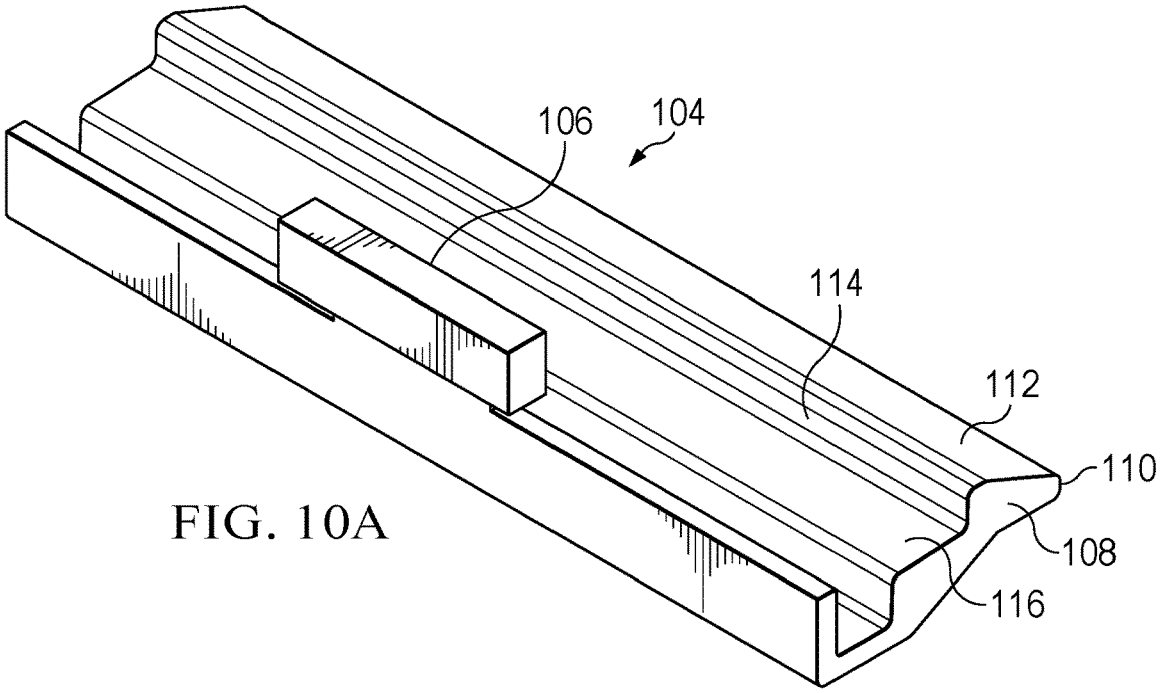
FIG. 10A (FIG. 10A) is a top rear perspective view of an exemplary upper or first connector clip.
Figure 10B:
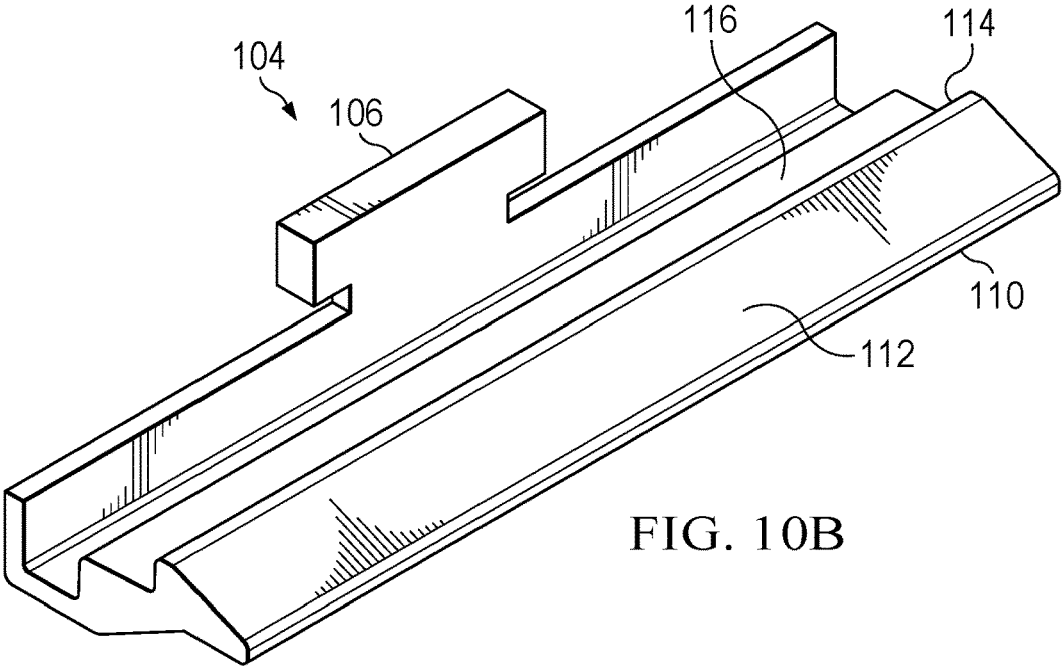
FIG. 10B (FIG. 10B) is a bottom rear perspective view of the exemplary upper or first connector clip.
Figure 11A:
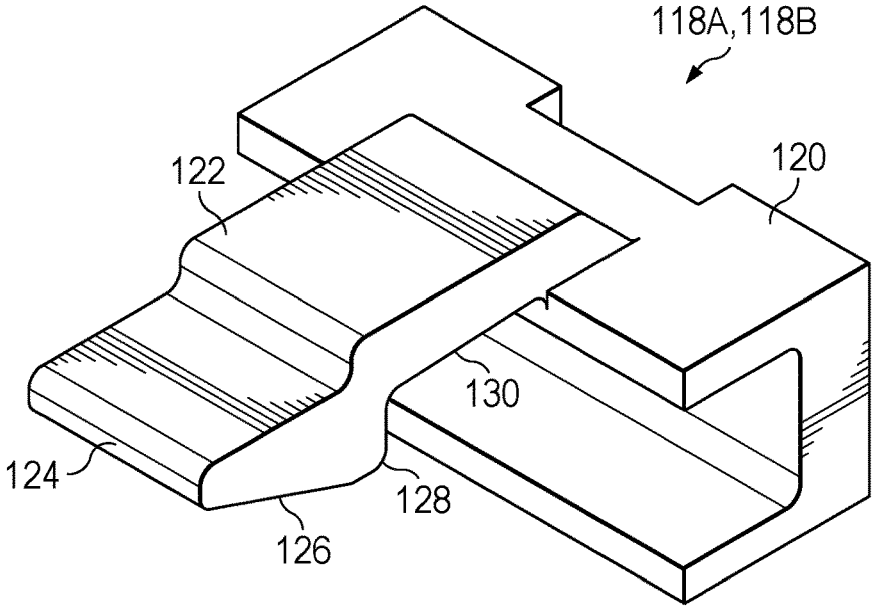
FIG. 11A (FIG. 11A) is a top rear perspective view of an exemplary lower or second connector clip.
Figure 11B:
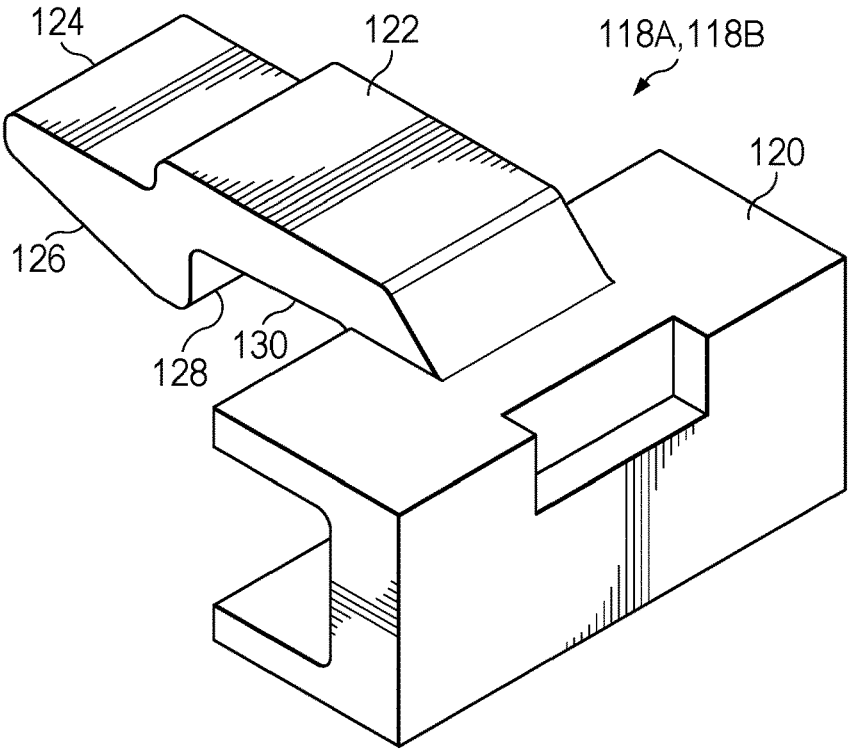
FIG. 11B (FIG. 11B) is a bottom rear perspective view of the exemplary lower or second connector clip.

There is a second mode of the apparatus 10, wherein the second mode blocks or impedes air from flowing through the air passageway 22 through the use of a solid plate 25 (arranged as shown in FIG. 7C) that is positioned in the air passageway 22 when filter 24 is removed. FIG. 9C depicts that the plate 25 of the second mode inhibits or impedes airflow, represented by arrows 82, such that the solid plate 25 blocks air movement to effectively "close" the vent register such that airflow 82 substantially does not leave duct 14.

FIG. 8 through FIG. 11B depict a second embodiment of the apparatus 10 that includes a variety of clip connectors to effectuate toolless installation of apparatus on wall 12. When the apparatus 10 is utilized without any fasteners 42 to thereby effectuate a toolless (no screwdriver, no drill) installation, there may be at least one clip connector 102 attached to the rear surface 53 of the vent housing body 16. The clip connector 102 provides a snap-in attachment of the vent housing body 16 to one of the 12 wall and the air duct 14 to align the air passageway 22 with the air duct 14 to effectuate a toolless installation of the air vent apparatus 10.

In one embodiment, the at least one clip connector 102 includes an upper clip connector 104 attached to the top wall 47 of the vent housing body 16. The upper clip connector 104 is centered on the top wall 47 between the first sidewall 46 and the second sidewall 48. Upper clip connector 104 may include a T-shaped member 106. the T-shaped member couples with the upper slot 57 to attach the upper clip connector 104 to the vent housing body 16. Upper clip connector 104 may include a clip arm 108, wherein the clip arm extends rearward in the transverse direction in a cantilevered manner from the rear surface 53 of the vent housing body 16 to a rear terminal end 110 of the clip arm. Clip arm 108 further includes an upwardly facing surface 112 on the clip arm 108 of the upper clip connector 104. The upwardly facing surface 112 tapers from an edge 114 to the terminal end 110. A ledge 116 on the clip arm 108 of the upper clip connecter 104 is located below the edge 114 of the upwardly facing surface 112. The ledge 116 is located between the T-shaped member 106 and the terminal end 110, wherein the ledge 116 is configured to engage one of the wall 12 and the air duct 14 after the toolless installation of the vent housing body.

This embodiment of apparatus 10 may also include a first lower clip connector 118A attached to the bottom wall 49 of the vent housing body 16, and a second lower clip connector 118B attached to the bottom wall of the vent housing body, and is spaced apart from the first lower clip 118A relative to the longitudinal direction. The first lower clip connector 118A and the second lower clip connector 118B are on opposite sides of a center of the bottom wall 49. Each lower clip connector 118A, 118B includes an end member 120 that is configured to be received by a portion of the lower wall of the vent housing body. Particularly, the end member 120 is received in the perimeter channel 55, which may be a C-shaped channel, such that the end member 120 is shaped complementary to the C-shaped perimeter channel 55 to nest or fit therein. There is a clip arm 122 on each lower clip 118A, 118B. The clip arm 122 extends rearward in the transverse direction in a cantilevered manner from the rear surface 53 of the vent housing body 16 to a rear terminal end 124 of the clip arm 122. Each lower slot 59, 61 receives one clip arm 122 therein. The clip arm 122 has a downwardly facing surface 126 on the clip arm 122. The downwardly facing surface 126 tapers from an edge 128 to the terminal end 124. A downwardly facing ledge 130 on the clip arm 122 of each lower clip 118A, 118B is located above the edge 128 of the downwardly facing surface 126. The ledge 130 is located between the end member 120 and the terminal end 124, wherein the ledge 130 is configured to engage one of the wall 12 and the air duct 14 after the toolless installation of the vent housing body 16. Together the first lower clip connector 118A and the second lower clip connector 118B provide a snap-in engagement to one of the wall 12 and the air duct 14 in the toolless installation of the vent housing body 16. Alternatively, two clip connectors may be located on respective sidewalls 46, 48 to provide a snap-in engagement to one of the wall 12 and the air duct 14 in the toolless installation of the vent housing body 16.

Figure 12:
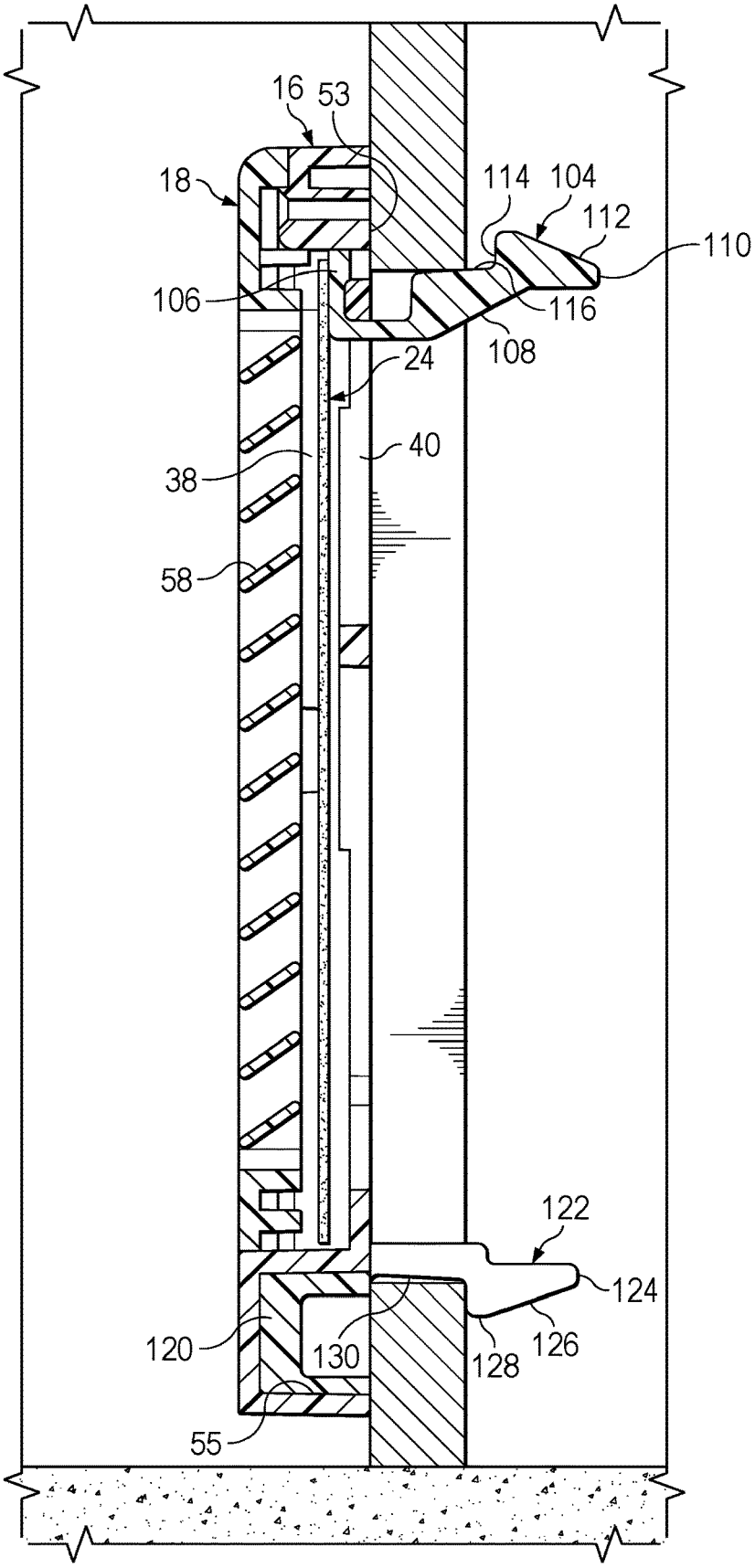
FIG. 12 (FIG. 12) is a transverse cross section view taken along line 12-12 in FIG. 8 depicting a filtered air vent apparatus that was installed via connector clips instead of screws or fasteners.

FIG. 12 depicts the apparatus 10 after having been installed in the toolless configuration taught herein. As seen in FIG. 12, no screws or fasteners that would need a tool (e.g., a screwdriver or drill) are utilized to attach apparatus 10 to the wall 12 or duct 14. Simply, only at least one clip connector 102, such as upper clip connector 104 and/or lower clip connectors 118A, 118B enable the apparatus to be pressed and snap-fit into attachment with the wall. The upper clip connector 104 is engaged with the housing body 16 and extends rearward from rear surface 53. The clip arm 108 of the upper clip connector may be made from a slightly flexible but generally rigid material that allows the clip arm 108 to deflect downward in response to a rearward movement (i.e., toward the wall) of apparatus 10. When the tapered surface 112 contacts the edge of the hole in wall 12 that aligns with the air duct 14, the clip arm 108 will gently flex downward to allow the clip arm 108 to move past (i.e., rearward) of the hole. Then, once edge 114 is rearward of the hole in wall 12, the clip arm 108 will resiliently flex back into its normal state as shown in FIG. 12. The edge defining the hole in the wall 12 will contact the ledge 114 and the edge 114 will be located behind the wall 114 and retain the vent housing body 16 on the wall 12. As such, the installation of the vent housing body 16 is a snap-in connection such that no screws are utilized to attach vent housing body 16 to the wall 12.

A similar arrangement is used for the lower clip connectors 118A/118B. The lower clip connectors 118A, 118B are engaged with the housing body 16 and extend rearward from rear surface 53. The clip arm 122 of the lower clip connectors 118A, 118B may be made from a slightly flexible but generally rigid material that allows the clip arm 108 to deflect upward in response to a rearward movement (i.e., toward the wall) of apparatus 10. When the tapered surface 126 contacts the edge of the hole in wall 12 that aligns with the air duct 14, the clip arm 122 will gently flex upward to allow the clip arm 122 to move past (i.e., rearward) of the hole. Then, once edge 128 is rearward of the hole in wall 12, the clip arm 122 will resiliently flex back into its normal state as shown in FIG. 12. The edge defining the hole in the wall 12 will contact the ledge 130 and the edge 128 will be located behind the wall 114 and retain the vent housing body 16 on the wall 12. As such, the installation of the vent housing body 16 is a snap-in connection such that no screws are utilized to attach vent housing body 16 to the wall 12.

Further, in the alternative embodiments, the clip connectors can be positioned on sidewalls 46, 48 rather than top wall 47 and bottom wall 49. In this version, the operation of the clip connectors would function similar to that which was described above but rather than deflecting upward or downward in response the rearward pushing movement that effectuates the snap-in configuration, the clip connectors would resilient deflect side-to-side.

The apparatus 10, device, assembly, or system of the present disclosure may additionally include one or more sensor to sense or gather data pertaining to the surrounding environment or operation of the apparatus 10, device, assembly, or system. Some exemplary sensors capable of being electronically coupled with the apparatus 10, device, assembly, or system of the present disclosure (either directly connected to the apparatus 10, device, assembly, or system of the present disclosure or remotely connected thereto) may include but are not limited to: accelerometers sensing accelerations experienced during rotation, translation, velocity/speed, location traveled, elevation gained; gyroscopes sensing movements during angular orientation and/or rotation, and rotation; altimeters sensing barometric pressure, altitude change, terrain climbed, local pressure changes, submersion in liquid; impellers measuring the amount of fluid passing thereby; Global Positioning sensors sensing location, elevation, distance traveled, velocity/speed; audio sensors sensing local environmental sound levels, or voice detection; Photo/Light sensors sensing ambient light intensity, ambient, Day/night, UV exposure; TV/IR sensors sensing light wavelength; Temperature sensors sensing machine or motor temperature, ambient air temperature, and environmental temperature; and Moisture Sensors sensing surrounding moisture levels.

The apparatus 10, device, assembly, or system of the present disclosure may include wireless communication logic coupled to sensors on the device, assembly, or system. The sensors gather data and provide the data to the wireless communication logic. Then, the wireless communication logic may transmit the data gathered from the sensors to a remote device. Thus, the wireless communication logic may be part of a broader communication system, in which one or several devices, assemblies, or systems of the present disclosure may be networked together to report alerts and, more generally, to be accessed and controlled remotely. Depending on the types of transceivers installed in the device, assembly, or system of the present disclosure, the system may use a variety of protocols (e.g., Wifi, ZigBee, MiWi, Bluetooth) for communication. In one example, each of the devices, assemblies, or systems of the present disclosure may have its own IP address and may communicate directly with a router or gateway. This would typically be the case if the communication protocol is WiFi. For example, a signal may be generated by a sensor or other scheduled-based manner to send a WiFi communication pertaining the filter's useful life or need for replacement.

The system that receives and processes signals from the device, assembly, or system of the present disclosure may differ from embodiment to embodiment. In one embodiment, alerts and signals from the device, assembly, or system of the present disclosure are sent through an e-mail or simple message service (SMS; text message) gateway so that they can be sent as e-mails or SMS text messages to a remote device, such as a smartphone, laptop, or tablet computer, monitored by a responsible individual, group of individuals, or department, such as a maintenance department or a homeowner. Thus, if a particular device, assembly, or system of the present disclosure creates an alert because of a data point gathered by one or more sensors, that alert can be sent, in e-mail or SMS form, directly to the individual responsible for fixing it or replacing the filter. Of course, e-mail and SMS are only two examples of communication methods that may be used; in other embodiments, different forms of communication may be used.

In other embodiments, alerts and other data from the sensors on the device or apparatus 10, assembly, or system of the present disclosure may also be sent to a work tracking system that allows the individual, or the organization for which he or she works, to track the status of the various alerts that are received, to schedule particular workers to repair a particular device, assembly, or system of the present disclosure, and to track the status of those repair jobs or when the filter needs replaced. A work tracking system would typically be a server, such as a Web server, which provides an interface individuals and organizations can use, typically through the communication network. In addition to its work tracking functions, the work tracker may allow broader data logging and analysis functions. For example, operational data may be calculated from the data collected by the sensors on the device, assembly, or system of the present disclosure, and the system may be able to provide aggregate machine operational data for a device, assembly, or system of the present disclosure or group of devices, assemblies, or systems of the present disclosure.

As described herein, aspects of the present disclosure may include one or more secondary components and/or systems therein. The apparatus 10 of the present disclosure is therefore contemplated and will be understood to include any necessary operational components thereof. For example, it will be further understood that any connections between various components not explicitly described herein may be made through any suitable means including mechanical fasteners, or more permanent attachment means, such as welding or the like. Alternatively, where feasible and/or desirable, various components of the present disclosure may be integrally formed as a single unit.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

While components of the present disclosure are described herein in relation to each other, it is possible for one of the components disclosed herein to include inventive subject matter, if claimed alone or used alone. In keeping with the above example, if the disclosed embodiments teach the features of A and B, then there may be inventive subject matter in the combination of A and B, A alone, or B alone, unless otherwise stated herein.

As used herein in the specification and in the claims, the term "effecting" or a phrase or claim element beginning with the term "effecting" should be understood to mean to cause something to happen or to bring something about. For example, effecting an event to occur may be caused by actions of a first party even though a second party actually performed the event or had the event occur to the second party. Stated otherwise, effecting refers to one party giving another party the tools, objects, or resources to cause an event to occur. Thus, in this example a claim element of "effecting an event to occur" would mean that a first party is giving a second party the tools or resources needed for the second party to perform the event, however the affirmative single action is the responsibility of the first party to provide the tools or resources to cause said event to occur.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

To the extent that the present disclosure has utilized the term "invention" in various titles or sections of this specification, this term was included as required by the formatting requirements of word document submissions pursuant the guidelines/requirements of the United States Patent and Trademark Office and shall not, in any manner, be considered a disavowal of any subject matter.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed:

1. A method for an air vent apparatus, the method comprising:

moving a vent housing body toward an opening defined in a wall, wherein the opening is in communication with an air duct;

connecting the vent housing body to one of the wall and the air duct via a toolless installation, wherein the toolless installation of the vent housing body to one of the wall and the air duct is effectuated by a clip connector;

hingedly connecting a grill to the vent housing body; and disposing a filter between the grill and the vent housing body.

2. The method of claim 1, wherein the clip connector comprises a clip arm that extends rearward in a cantilevered manner from a rear surface of the vent housing body.

3. The method of claim 2, further comprising:

moving a terminal end of the clip arm through the opening in the wall that is aligned with the air duct;

contacting a tapered surface of the clip arm with an edge of the wall that defines the opening; and flexing the clip arm from a neutral position to a flexed position in response to the vent housing body moving toward the wall.

4. The method of claim 3, further comprising:

moving the tapered surface of the clip arm to a location behind the wall, wherein when the tapered surface is located behind the wall the clip arm returns to the neutral position.

5. The method of claim 4, wherein the clip connector establishes a snap-fit configuration that connects the vent housing body to the wall without the use of screws, a screwdriver or a drill.

6. A method for an air vent apparatus, the method comprising:

moving a vent housing body toward an opening defined in a wall, wherein the opening is in communication with an air duct;

connecting the vent housing body to one of the wall and the air duct via a toolless installation, wherein the toolless installation of the vent housing body to one of the wall and the air duct is effectuated by a plurality of clip connectors;

hingedly connecting a grill to the vent housing body; and disposing a filter between the grill and the vent housing body.

7. The method of claim 6, further comprising:

attaching at least one clip connector from the plurality of clip connectors to the vent housing body via a T-shaped member on the at least one clip connector.

8. The method of claim 7, further comprising:

Inserting a portion of the T-shaped member through a slot formed in the vent housing body.

9. The method of claim 8, wherein the slot is formed in a top wall of the vent housing body.

10. The method of claim 9, wherein the slot is a single slot formed in the top wall of the vent housing body and the single slot is located centrally between two sidewalls of the vent housing body.

11. The method of claim 7, further comprising:

attaching at least one clip connector to the vent housing body via an end member on the at least one clip connector.

12. The method of claim 11, wherein the end member is shaped complementary to and received within a perimeter channel formed in a rear surface of the vent housing body.

13. The method of claim 12, further comprising:

inserting a portion of the at least one clip through a slot formed in the vent housing body when the end member is disposed within the perimeter channel.

14. A method for an air vent apparatus, the method comprising:

moving a vent housing body toward an opening defined in a wall, wherein the opening is in communication with an air duct;

connecting the vent housing body to one of the wall and the air duct via a toolless installation;

hingedly connecting a grill to the vent housing body;

disposing a filter between the grill and the vent housing body;

hingedly opening the grill relative the vent housing body while the vent housing body remains connected one of the wall and the air duct, wherein the filter remains in the vent housing body when the grill is hinged open;

removing the filter from the vent housing body when the grill is hinged open; and installing a plate in the vent housing body in a space previously occupied by the filter after having removed the filter, wherein the plate is operable to preclude or inhibit air flow through the grill.

15. A method for an air vent apparatus, the method comprising:

moving a vent housing body toward an opening defined in a wall, wherein the opening is in communication with an air duct;

connecting the vent housing body to one of the wall and the air duct via a toolless installation, wherein the toolless installation of the vent housing body to one of the wall and the air duct is effectuated by a clip connector, wherein the clip connector comprises a clip arm that extends rearward in a cantilevered manner from a rear surface of the vent housing body;

moving a terminal end of the clip arm through the opening in the wall that is aligned with the air duct;

contacting a tapered surface of the clip arm with an edge of the wall that defines the opening;

flexing the clip arm from a neutral position to a flexed position in response to the vent housing body moving toward the wall;

hingedly connecting a grill to the vent housing body; and disposing a filter between the grill and the vent housing body.

16. A method for an air vent apparatus, the method comprising:

moving a vent housing body toward an opening defined in a wall, wherein the opening is in communication with an air duct;

connecting the vent housing body to one of the wall and the air duct via a toolless installation, wherein the toolless installation of the vent housing body to one of the wall and the air duct is effectuated by a plurality of clip connectors;

attaching at least one clip connector from the plurality of clip connectors to the vent housing body via a T-shaped member on the at least one clip connector;

hingedly connecting a grill to the vent housing body; and disposing a filter between the grill and the vent housing body.

17. The method of claim 1, further comprising: hingedly opening the grill relative the vent housing body while the vent housing body remains connected one of the wall and the air duct, wherein the filter remains in the vent housing body when the grill is hinged open.

18. The method of claim 17, further comprising: removing the filter from the vent housing body when the grill is hinged open.

19. The method of claim 18, further comprising: installing a plate in the vent housing body in a space previously occupied by the filter after having removed the filter, wherein the plate is operable to preclude or inhibit air flow through the grill.

20. The method of claim 17, further comprising: maintaining the filter stationary as the grill is hinged open.

21. The method of claim 18, further comprising: maintaining a height dimension of the filter parallel to a vertical direction as the filter remains stationary as the grill is hinged open, wherein the height dimension of the filter is less than a length dimension of the filter and greater than a thickness dimension of the filter.

* * * * *